US008138859B2

(12) United States Patent
Gritters et al.

(10) Patent No.: US 8,138,859 B2
(45) Date of Patent: Mar. 20, 2012

(54) SWITCH FOR USE IN MICROELECTROMECHANICAL SYSTEMS (MEMS) AND MEMS DEVICES INCORPORATING SAME

(75) Inventors: John K. Gritters, Livermore, CA (US); Eric D. Hobbs, Livermore, CA (US); Sangtae Park, Dublin, CA (US); Jun Jason Yao, San Ramon, CA (US)

(73) Assignee: FormFactor, Inc., Livermore, CA (US)

( * ) Notice: Subject to any disclaimer, the term of this patent is extended or adjusted under 35 U.S.C. 154(b) by 778 days.

(21) Appl. No.: 12/106,364

(22) Filed: Apr. 21, 2008

(65) Prior Publication Data

US 2009/0260960 A1 Oct. 22, 2009

(51) Int. Cl.
*H01H 51/22* (2006.01)
*H01H 57/00* (2006.01)

(52) U.S. Cl. ..... 335/78; 200/181; 335/83

(58) Field of Classification Search ..... 335/78, 335/83; 200/181
See application file for complete search history.

(56) References Cited

U.S. PATENT DOCUMENTS 5,025,346 A 6/1991 Tang et al.
6,133,670 A 10/2000 Rodgers et al.
6,306,688 B1 10/2001 Lunceford
6,313,023 B1 11/2001 Maruyama
6,384,707 B2 5/2002 Minners
6,465,929 B1 * 10/2002 Levitan et al. ..... 310/309
6,486,425 B2 * 11/2002 Seki ..... 200/181
6,506,989 B2 * 1/2003 Wang ..... 200/181
6,608,268 B1 8/2003 Goldsmith
6,621,390 B2 * 9/2003 Song et al. ..... 335/78
6,624,003 B1 9/2003 Rice
6,636,653 B2 10/2003 Miracky et al.
6,707,355 B1 3/2004 Yee
6,809,539 B2 10/2004 Wada et al.
6,865,313 B2 * 3/2005 Mao et al. ..... 385/18
6,891,454 B1 5/2005 Naito et al.
6,898,358 B2 5/2005 Li et al.
6,917,268 B2 * 7/2005 Deligianni et al. ..... 335/78
6,917,276 B1 7/2005 Menard et al.
6,922,509 B2 7/2005 Hamada
6,937,040 B2 8/2005 Maeda et al.
6,947,649 B2 9/2005 Li et al.
6,975,193 B2 * 12/2005 Knieser et al. ..... 335/78
6,992,551 B2 1/2006 Shimizu et al.

(Continued)

OTHER PUBLICATIONS

Komura, Y. et al., "Micro Machined Relay for High Frequency Application," NARM 1999.

(Continued)

*Primary Examiner* — Anh Mai
*Assistant Examiner* — Alexander Talpalatskiy
(74) *Attorney, Agent, or Firm* — Kirton & McConkie

(57) ABSTRACT

Embodiments of the present invention provide microelectromechanical systems (MEMS) switching methods and apparatus having improved performance and lifetime as compared to conventional MEMS switches. In some embodiments, a MEMS switch may include a resilient contact element comprising a beam and a tip configured to wipe a contact surface; and a MEMS actuator having an open position that maintains the tip and the contact surface in a spaced apart relation and a closed position that brings the tip into contact with the contact surface, wherein the resilient contact element and the MEMS actuator are disposed on a substrate and are movable in a plane substantially parallel to the substrate. In some embodiments, various contact elements are provided for the MEMS switch. In some embodiments, various actuators are provided for control of the operation of the MEMS switch.

24 Claims, 15 Drawing Sheets

U.S. PATENT DOCUMENTS

| | | | | |
|---|---|---|---|---|
| 7,019,938 | B2 | 3/2006 | Miyata et al. | |
| 7,036,312 | B2 | 5/2006 | Menard et al. | |
| 7,053,351 | B2 | 5/2006 | Li et al. | |
| 7,053,736 | B2 * | 5/2006 | Nelson | 335/70 |
| 7,057,135 | B2 | 6/2006 | Li | |
| 7,106,066 | B2 | 9/2006 | Ivanciw et al. | |
| 7,119,943 | B2 | 10/2006 | Nelson et al. | |
| 7,124,499 | B2 | 10/2006 | Villeneuve et al. | |
| 7,151,244 | B2 | 12/2006 | Cheng et al. | |
| 7,170,216 | B2 | 1/2007 | Sanpei et al. | |
| 7,179,116 | B2 | 2/2007 | Menard et al. | |
| 7,185,542 | B2 | 3/2007 | Bang et al. | |
| 7,190,092 | B2 | 3/2007 | Ivanciw et al. | |
| 7,194,153 | B1 | 3/2007 | Yajima et al. | |
| 7,198,961 | B2 | 4/2007 | Li et al. | |
| 7,209,083 | B2 | 4/2007 | Fujishima et al. | |
| 7,209,858 | B1 | 4/2007 | Cheng | |
| 7,263,217 | B2 | 8/2007 | Kawaike et al. | |
| 7,274,570 | B2 | 9/2007 | Ishizaki | |
| 7,289,696 | B2 | 10/2007 | Fujisawa et al. | |
| 7,432,788 | B2 * | 10/2008 | Glukh et al. | 335/78 |
| 7,446,634 | B2 * | 11/2008 | Jeong et al. | 335/78 |
| 7,463,126 | B2 * | 12/2008 | Masuda et al. | 335/78 |
| 7,705,699 | B2 * | 4/2010 | Chou et al. | 335/78 |
| 2002/0050881 | A1 * | 5/2002 | Hyman et al. | 335/78 |
| 2002/0105699 | A1 | 8/2002 | Miracky et al. | |
| 2002/0119605 | A1 | 8/2002 | Lunceford | |
| 2002/0153236 | A1 * | 10/2002 | Song et al. | 200/181 |
| 2003/0132823 | A1 * | 7/2003 | Hyman et al. | 335/78 |
| 2003/0174961 | A1 | 9/2003 | Hamada | |
| 2003/0235331 | A1 | 12/2003 | Kawaike et al. | |
| 2004/0056742 | A1 * | 3/2004 | Dabbaj | 335/78 |
| 2004/0061579 | A1 * | 4/2004 | Nelson | 335/78 |
| 2004/0080862 | A1 | 4/2004 | Miyata et al. | |
| 2004/0207498 | A1 * | 10/2004 | Hyman et al. | 335/78 |
| 2005/0040808 | A1 * | 2/2005 | Herbert et al. | 324/99 R |
| 2005/0040919 | A1 * | 2/2005 | Baeck et al. | 335/78 |
| 2005/0096878 | A1 | 5/2005 | Ivanciw et al. | |
| 2005/0195056 | A1 | 9/2005 | Sanpei et al. | |
| 2005/0270129 | A1 | 12/2005 | Menard et al. | |
| 2006/0087390 | A1 * | 4/2006 | Yuba et al. | 335/78 |
| 2006/0164309 | A1 | 7/2006 | Fujishima et al. | |
| 2006/0166565 | A1 | 7/2006 | Menard et al. | |
| 2006/0208328 | A1 | 9/2006 | Sano et al. | |
| 2006/0208837 | A1 | 9/2006 | Masuda et al. | |
| 2006/0209520 | A1 | 9/2006 | Masai et al. | |
| 2006/0238279 | A1 | 10/2006 | Lu et al. | |
| 2006/0273692 | A1 | 12/2006 | Sanpei et al. | |
| 2006/0280421 | A1 | 12/2006 | Tanaka et al. | |
| 2007/0078623 | A1 | 4/2007 | Cheng | |
| 2007/0086697 | A1 | 4/2007 | Yamamoto et al. | |
| 2007/0092180 | A1 | 4/2007 | Hashimura et al. | |
| 2007/0128831 | A1 | 6/2007 | Oka et al. | |
| 2007/0160540 | A1 | 7/2007 | Nishigaki et al. | |
| 2007/0176715 | A1 | 8/2007 | Nakanishi | |
| 2007/0222678 | A1 | 9/2007 | Ishio et al. | |
| 2007/0224953 | A1 | 9/2007 | Nakagawa et al. | |
| 2007/0269199 | A1 | 11/2007 | Mori et al. | |

OTHER PUBLICATIONS

Yao, J. Jason, "RF MEMS From a Device Perspective," J. Micromech. Microeng. 10 R9-R38, 2000, pp. 1-33.

* cited by examiner

SWITCH FOR USE IN MICROELECTROMECHANICAL SYSTEMS (MEMS) AND MEMS DEVICES INCORPORATING SAME

BACKGROUND OF THE INVENTION

1. Field of the Invention

The present invention generally relates to microelectromechanical systems (MEMS), and more particularly, to switches used in MEMS devices.

2. Description of the Related Art

Many systems, such as semiconductor testing systems, electronic circuits, microelectromechanical systems (MEMS), or the like (as non-limiting examples), often utilize switches to selectively make contacts to route electrical signals through the systems to facilitate the use and/or control thereof. Such switches are typically expected to have a fixed lifetime, such that any problem that interferes with the operation or performance of the switch typically effectively destroys the system. For example, the electrical performance of the switch may be degraded due to oxidation of the contacts of the switch. In addition, contact pad wear due to switch operation may also degrade the performance and/or the life of the switch. Further, particles or other contaminants may also interfere with switch performance.

Thus, there is a need for an improved switch for such systems.

SUMMARY OF THE INVENTION

Embodiments of the present invention provide microelectromechanical systems (MEMS) switching methods and apparatus having improved performance and lifetime as compared to conventional MEMS switches. In some embodiments, a MEMS switch may include a resilient contact element comprising a beam and a tip configured to wipe (i.e., providing a wiping motion across) a contact surface; and a MEMS actuator having an open position that maintains the tip and the contact surface in a spaced apart relation and a closed position that brings the tip into contact with the contact surface, wherein the resilient contact element and the MEMS actuator are disposed on a substrate and are movable in a plane substantially parallel to the substrate. In some embodiments, various contact elements are provided for the MEMS switch. In some embodiments, various actuators are provided for control of the operation of the MEMS switch.

In some embodiments, a MEMS switch may include a resilient contact element comprising a beam flexible about a pivot point and having a tip disposed proximate an end of the beam and configured to engage a contact surface; and a MEMS actuator coupled to the resilient contact element and having an open position that maintains the tip and the contact surface in a spaced apart relation and a closed position that brings the tip into contact with the contact surface, wherein the actuator is coupled to the beam at a point remote from the pivot point.

In some embodiments, various multi-stage spring systems are provided herein. In some embodiments, a multi-stage spring system includes a spring assembly having at least one resilient element; and a tip coupled to the spring assembly and configured to wipe a contact surface upon continued deflection of the spring assembly after initial contact with the contact surface; wherein the spring assembly has a first spring constant when deflected up to a first distance, a greater, second spring constant when deflected beyond the first distance and up to a second distance, and a greater, third spring constant when deflected beyond the second distance and up to a third distance, and wherein the spring assembly stores mechanical energy when deflected towards the contact surface that biases the spring assembly away from the contact surface when released.

In some embodiments, a MEMS actuator may include a comb actuator movable between a first position and a second position; and a gap closing actuator coupled to the comb actuator, wherein opposing electrodes of the gap closing actuator are brought into operable proximity to each other when the comb actuator is in the second position.

In some embodiments, a MEMS actuator may include a gap closing actuator having a plurality of first electrodes and a plurality of second electrodes disposed parallel to the first electrodes and linearly movable in a non-normal and non-parallel direction with respect thereto.

In some embodiments, a MEMS actuator may include a first gap closing actuator comprising a first plurality of electrodes having a first gap disposed therebetween; and a second gap closing actuator comprising a second plurality of electrodes having a second gap disposed therebetween, the first gap closing actuator coupled to the second gap closing actuator such that the closing of the first gap partially closes the second gap.

BRIEF DESCRIPTION OF THE DRAWINGS

So that the manner in which features of the present invention can be understood in detail, a more particular description of the invention, briefly summarized above, may be had by reference to embodiments, some of which are illustrated in the appended drawings. It is to be noted, however, that the appended drawings illustrate only typical embodiments of this invention and are therefore not to be considered limiting of its scope, for the invention may admit to other equally effective embodiments.

Where possible, identical reference numerals are used herein to designate elements that are common to the figures. The images used in the drawings may be simplified for illustrative purposes and are not necessarily depicted to scale.

DETAILED DESCRIPTION

This specification describes exemplary embodiments and applications of the invention. The invention, however, is not limited to these exemplary embodiments and applications or to the manner in which the exemplary embodiments and applications operate or are described herein. In addition, as the terms "on" and "attached to" are used herein, one object (e.g., a material, a layer, a substrate, etc.) can be "on" or "attached to" another object regardless of whether the one object is directly on or attached to the other object or there are one or more intervening objects between the one object and the other object. Also, directions (e.g., above, below, top, bottom, side, up, down, "x," "y," "z," etc.), if provided, are relative and provided solely by way of example and for ease of illustration and discussion and not by way of limitation. In addition, where reference is made to a list of elements (e.g., elements a, b, c), such reference is intended to include any one or more of the listed elements by itself or in any combination. Moreover, the terms "open" and "closed" or an "open position" and a "closed position" as used herein with respect to actuator positions or states are illustrative and generally may be considered a "first position" and a "second position," respectively, and should not be confused with the open or closed state of a switch to which the actuator may be coupled.

I. General Discussion

Embodiments of the present invention provide microelectromechanical systems (MEMS) switching methods and apparatus which can have improved performance and lifetime as compared to conventional MEMS switches. In some embodiments, the switch may be utilized in MEMS radio frequency (RF) switching applications. Embodiments of the present inventive MEMS switches may include various wipe-inducing contact elements that may provide improved electrical contact, signal quality, switch lifetime, reduced contact stiction, and/or other benefits as described below. Embodiments of the inventive MEMS switches may include various MEMS actuating mechanisms for inducing the movement of the switch that may provide greater force application, low voltage operational requirements (such as less than or equal to about 3 Volts), and/or other benefits as described below.

Figure 1:
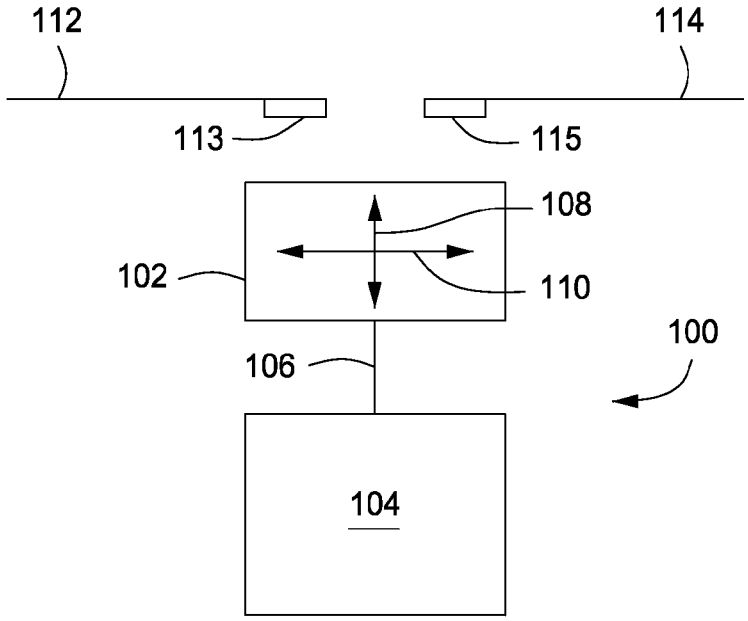
FIG. 1 depicts a schematic diagram of a MEMS switch in accordance with some embodiments of the present invention.

The inventive MEMS switch generally includes a contact element configured to make selective contact with one or more contact pads and an actuating mechanism for controlling the operation of the switch. For example, FIG. 1 depicts a MEMS switch 100 in accordance with some embodiments of the invention. The switch 100 may include a contact element 102 coupled to an actuator 104, as shown schematically by a link 106. The actuator 104 controls the motion of the contact element 102 in at least a direction towards and away from one or more contact pads for selectively opening and closing the switch 100, as depicted by arrows 108.

For example, as schematically shown in FIG. 1, a signal path 112 having a contact pad 113 and a signal path 114 having a contact pad 115 may be disposed proximate the contact element 102 in a normally open configuration, such that when the contact element 102 moves towards (e.g., when deflected by the actuator 104) and comes into contact with the respective contact pads 113, 115 of the paths 112, 114, the switch 100 may be closed. Such signal paths may generally be any electrical signal path. In some embodiments, the signal paths may be RF signal paths. Although shown as coupled to the contact element 102, the actuator 104 may be separate from the contact element 102 and may be configured to selectively engage the contact element 102 during operation of the switch (as described in more detail below in FIG. 2).

In some embodiments, the actuator 104 may deflect the contact element 102 in a direction away from the actuator and towards one or more contacts to be made by the switch (e.g., contact pads 113, 115). In some embodiments, actuation of the actuator 104 (e.g., moving from an initial position to a second position that deflects the contact element towards the contact pads 113, 115) may generate a restoring force biased away from the direction of movement of the actuator 104 that may facilitate returning the actuator 104 (and the contact element 102) to its initial position.

In some embodiments, the contact element 102 may also provide a motion at least partially laterally with respect to the contact pads 113, 115, as depicted by arrows 110. Such lateral motion of the contact element 102 may advantageously provide for a physical wipe of the contact pads 113, 115 by the contact element 102, thereby facilitating breaking through any oxide layer, particles, or other contamination that may be present between the contact element 102 and the contact pads 113, 115. In some embodiments, the contact element 102 may store mechanical energy upon wiping the contact pads, thereby providing a restoring force (or an increased restoring force) that may facilitate overcoming any stiction that may develop between the contact element 102 and any of the contact pads 113, 115 when the switch 100 is in the closed position. This restoring force may be independent of any restoring force that might be part of actuator 104, or may work in combination with any restoring force present in actuator 104.

In some embodiments, the switch 100 may comprise a wipe-capable switch. As used herein, the term "wipe capable" means that the switch 100 is configured to be able to wipe the contact pad (e.g., either or both of 113, 115) upon closing the switch 100. Such wipe may be provided selectively (e.g., the switch may be capable of closing with or without providing wipe) or each time the switch is closed. In addition, the magnitude of any wipe provided may be controlled such that the distance that the tip moves with respect to the contact pads after initial contact may be controlled as desired. The term "wipe" may be defined as lateral movement of the contact element of the switch across the contact pad after initial contact with the contact pad (e.g., the contact element of the switch initially contacts the contact pad at a first point, then wipes the surface of the contact pad as it moves to a second point). Thus, the term "wipe" includes any post-contact motion between contact elements and contact pads such that physical, frictional relative motion therebetween is developed. As used herein, the term "contact" includes any initial contact sufficient to establish electrical connection between contact elements and contact pads and any additional motion of either or both of contact elements and contact pads sufficient to induce wipe therebetween.

In some embodiments, any of the switches disclosed herein may be configured in plane substantially parallel to a substrate upon which the switch may be disposed. For example, each of the views of switches, or portions thereof (such as contact elements, springs, actuators, or the like), shown in the Figures contained herein may be top views of the respective components (or portions thereof) such that a substrate upon which the switch is disposed lies beneath the components illustrated in the various drawings. As such, the actuation of the switch (for example, the movement of the actuator 104 and the contact element 102, as shown in FIG. 1) may be in a plane substantially parallel to the page as drawn, and to the underlying substrate. Such substrate-parallel configuration may provide additional flexibility in configuration of the various components comprising the switch (e.g., the actuator, contact elements, contact pads on the substrate, and the like) and/or improved performance as compared to substrate-perpendicular configurations (e.g., where the contact elements of the switch move primarily perpendicularly with respect to an underlying substrate upon which the contact pads are disposed).

Various embodiments of MEMS switches in accordance with the teachings of the present invention as disclosed herein are contemplated. Additionally, it is contemplated that one or more features of each of the embodiments disclosed herein may be combined with one or more features of any other embodiments provided to the extent not inconsistent with the present teachings.

Figure 2:
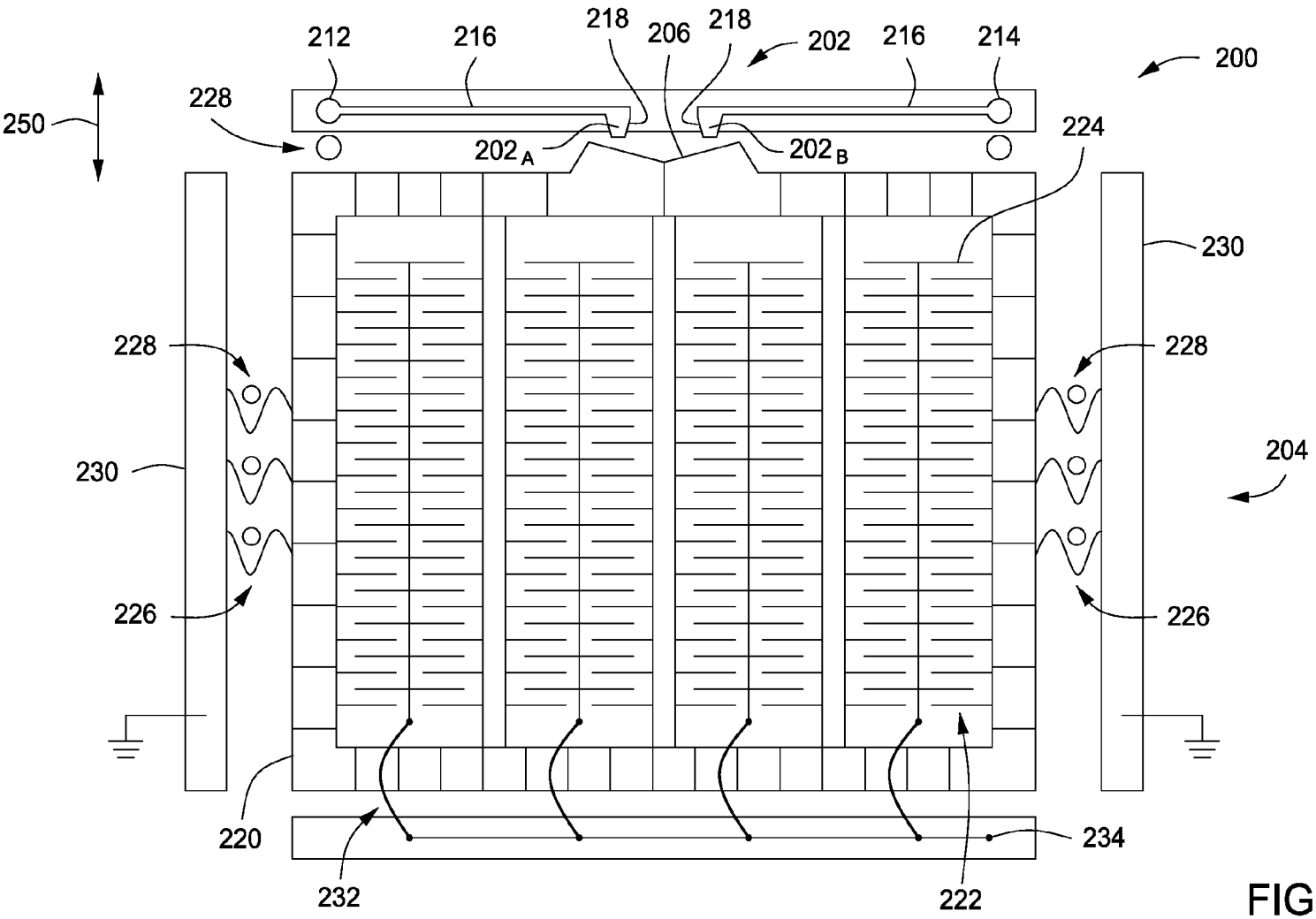
FIG. 2 depicts a schematic diagram of a MEMS switch in accordance with some embodiments of the present invention.

FIG. 2 depicts one illustrative example of a MEMS switch 200 in accordance with some embodiments of the invention. The switch 200 is generally similar to the switch 100 described above and embodies some of the many variations contemplated. The switch 200 may be fabricated using simple, low-cost techniques and may be lithographically fabricated on a common substrate. As discussed above, the switch 200 can be fabricated in a plane generally parallel to the underlying substrate.

The switch 200 can include a contact element 202 and an actuator 204 configured to selectively control the position of the switch 200 from a first position to a second position (corresponding to, for example, open or closed positions of the switch, or vice versa). In some embodiments, the contact element 202 may comprise a pair of resilient contact elements $\mathbf{202}_A$ and $\mathbf{202}_B$. In some embodiments, the contact element 202 (or contact elements $\mathbf{202}_A$ and $\mathbf{202}_B$) may include a resilient beam 216 having a tip 218 disposed at an end thereof. In some embodiments, and as depicted in FIG. 2, the contact element 202 (or elements $\mathbf{202}_A$ and $\mathbf{202}_B$) may be coupled to signal paths 212, 214 (for example at an end of the resilient beam 216 opposite the tip 218) and disposed in a normally spaced apart relation with the actuator 204.

The actuator 204 may have one or more contact pads 206 for selectively making contact with respective tips of the contact element 202 (or elements $\mathbf{202}_A$ and $\mathbf{202}_B$). In some embodiments, the contact pads 206 may be disposed at a non-parallel angle with respect to the contact element 202 (or elements $\mathbf{202}_A$ and $\mathbf{202}_B$) to facilitate inducing wipe upon contact therebetween. In some embodiments, the contact pads 206 may be disposed non-parallel (e.g., at an angle) to the contact element 202 (or elements $\mathbf{202}_A$ and $\mathbf{202}_B$) such that wipe may be developed through configuration of the contact element 202 (or elements $\mathbf{202}_A$ and $\mathbf{202}_B$). For example, when resilient beam 216 is deflected (e.g., upward in reference to the drawing), such movement will cause the elements $\mathbf{202}_A$ and $\mathbf{202}_B$ to wipe the contact pads 206.

The actuator 204 may comprise any suitable actuator, including but not limited to any of the actuators described in more detail below. In some embodiments, the actuator 204 may comprise an electrostatic gap closing actuator. For example, as depicted in FIG. 2, the actuator 204 includes a movable frame 220 that supports a plurality of movable electrodes 222 proximate a mating plurality of fixed electrodes 224. The frame 220 is movable between a first, resting position (normally open as shown in FIG. 2) and a second, actuated position (a closed position, or up the page, as shown in FIG. 2 and denoted by arrows 250). One or more springs may be provided in the actuator 204 to facilitate returning the frame 220 to the resting position. For example, a plurality of shuttle springs 226 and bumpers 228 may be provided to store mechanical energy upon actuation of the actuator 204. In some embodiments, the shuttle springs 226 may be coupled to a fixed structure 230 to provide a support and fixed frame of reference for the shuttle springs 226 and the movable frame 220.

To facilitate generating an electrostatic attractive force between the fixed and movable electrodes 224, 222, one of the fixed or movable electrodes 224, 222 is generally grounded and the other coupled to a power source for selectively providing a voltage thereto. Thus, the potential difference between the powered and grounded electrodes develops an electrostatic attractive force therebetween, and causing the movable electrodes 222 to move towards the fixed electrodes 224. In the embodiment depicted in FIG. 2, the movable electrode 222 may be grounded, for example, by a ground connection made to the fixed structure 230. The fixed electrodes 224 may be powered, for example, through a plurality of connections (such as wire bonds 232) made to a bus 234 or other element to which a connection may be made to the power source (not shown).

In operation, the force generated by the actuator 204 is a function of the voltage applied, the distance, or gap, between the respective fixed and movable electrodes 224, 222, and the surface area over which the electrostatic potential develops (e.g., the mating surface area of the opposing electrodes times the number of pairs of electrodes provided). Although one geometry is shown in FIG. 2 having four rows of a given number of electrodes, it is contemplated that one or more rows of electrodes may be provided of varying size and number, and that the mating electrodes need not be provided in rows, that multiple rows or sets of mating electrodes need not have the same configuration as each other, or the like.

II. Contact Element Examples

Embodiments of the present invention may utilize a variety of contact element configurations. Such contact elements may have any suitable form for generating or providing a wiping action during use. For example, the contact element can include a beam having a first end configured with a tip for contacting the surface of a contact pad and a second end configured to be attached to a supporting substrate (not shown).

The beam, or portions thereof, may comprise one or more layers and may comprise one or more electrically conductive, semiconductive, and/or nonconductive materials. Examples of suitable conductive materials include metals. In some embodiments, the beam may comprise nickel, copper, cobalt, iron, gold, silver, elements of the platinum group, noble metals, semi-noble metals, elements of the palladium group, tungsten, molybdenum, beryllium, and the like, and alloys thereof (such as, but not limited to, nickel-cobalt alloys, copper-beryllium alloys, or the like). Examples of non-conductive materials include silicon dioxide. Examples of semiconductive materials include silicon.

The tip may be formed integrally with the beam or may comprise a separate layer or layers. In some embodiments, the tip may be fabricated from any of the above materials. In some embodiments, the tip may be fabricated from noble metals and semi-noble metals, such as palladium, gold, rhodium, and combinations or alloys thereof (such as palladium-cobalt alloys, nickel-palladium alloys, or the like), and the like.

The contact pad may generally be fabricated, at least in part, from any suitable electrically conductive material. Examples of such materials may include any of the conductive materials discussed above with respect to the beam and the tip of the contact element. Although examples of specific materials for the beam and tip of the contact element and the contact pad of the switch are provided herein, the specific materials are not intended to be limited by such examples and any suitable materials for providing the function of the contact element and/or the contact pad in accordance with the teachings provided herein are contemplated.

The contact element typically has a spring constant and yield strength suitable for developing sufficient contact force when contacting a contact pad (e.g., sufficient to break through an oxide layer on the surface of the contact pad and/or sufficient to provide a reliable temporary pressure contact suitable for transmission of an electric signal therebetween) for repeated temporary contacting of the contact elements without permanent deformation thereof. It is contemplated that the contact element may have a suitable spring constant or constants for various applications where particular contact forces are required to establish reliable temporary electrical contact with the contact pad without damaging either the resilient contact element or the contact pad.

Figure 3A:
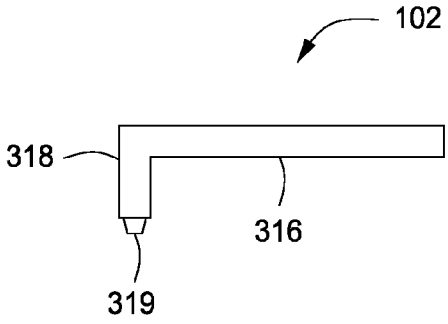
FIGS. 3A-C depict non-limiting examples of springs suitable for use in MEMS switches in accordance with some embodiments of the invention.
Figure 3B:
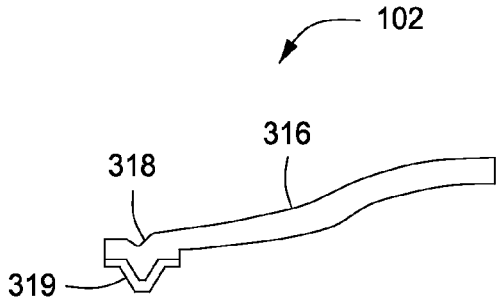
Figure 3C:
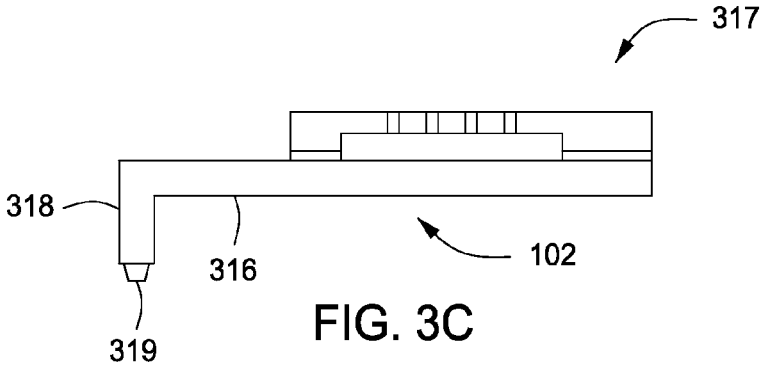

For example, FIGS. 3A-C depict a few non-limiting examples of the many embodiments of contact elements suitable for use in MEMS switches as described herein. In some embodiments, as depicted in FIG. 3A, the contact element 102 may include a resilient beam 316 having a tip 318 disposed at an end thereof. The tip 318 may be configured to contact a contact pad of a MEMS switch directly, or may include a contact 319 suitable for contacting the contact pad.

The beam 316 may be linear, as shown in FIG. 3A, or in some embodiments and as depicted in FIG. 3B, the beam 316 may be non-linear. In some embodiments and as depicted in FIG. 3C, the contact element 102 may include a reinforcement member 317 may be coupled to the resilient beam 316C. In some embodiments, the reinforcement member 317 may be coupled to the resilient beam 316C via a bonding layer 330 (such as an adhesive, or the like). Alternatively, the reinforcement member 317 may be fabricated integrally with the resilient beam 316C. In some embodiments, the reinforcement member 317 and the resilient beam 316C may be configured in a box spring configuration. Alternatively, a resilient portion 332 may be provided in the reinforcement member 317. The resilient portion 332 may provide a torsional spring effect.

Examples of additional suitable spring configurations that may be found in commonly assigned U.S. patent application Ser. No. 11/611,874, filed Dec. 17, 2006, and entitled, "Reinforced Contact Elements," Ser. No. 11/617,373, filed Dec. 28, 2006, and entitled, "Resilient Contact Elements and Methods of Fabrication," Ser. No. 11/617,394, filed Dec. 28, 2006, and entitled, "Rotating Contact Element and Methods of Fabrication," and Ser. No. 11/862,172, filed Sep. 26, 2007, and entitled, "Reduced Scrub Contact Element."

Some actuators, for example electrostatic gap closing actuators, may provide relatively small ranges of motion. Accordingly, a contact element configuration may be provided that can amplify the range of motion provided by the actuator to obtain greater range of motion of the tip of the contact element. The increased range of motion may provide greater flexibility in design of the switch, may enable the switch to possess greater wipe for a given actuation voltage, as compared to conventional designs, or the like.

Figure 4:
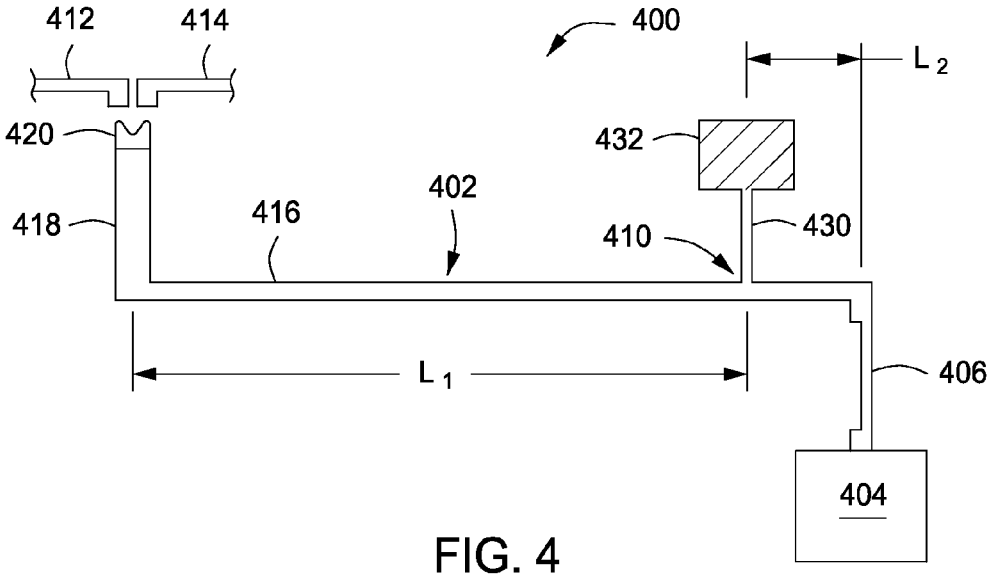
FIG. 4 depicts a schematic diagram of a MEMS switch in accordance with some embodiments of the present invention.

For example, FIG. 4 depicts an illustrative example of a MEMS switch 400 in accordance with some embodiments of the invention. The switch 400 is generally similar to the switch 100 described above and embodies some of the many variations contemplated herein. The switch 400 may include a contact element 402 constrained about a pivot point 410 and coupled to an actuator 404. The contact element 402 may include a beam 416 having a tip 418 disposed at one end of the beam 416. The beam 416 may be constrained at the pivot point 410, such as by providing a flexible connection 430 extending from an anchor, or fixed structure 432, to a particular location on the beam 416. The tip 418 is generally configured to make temporary electrical contact with contact pads provided, for example, along signal path 412 and signal path 414, to selectively close and open the switch 400 as desired during operation. The tip 418 may have a contact 420 disposed thereon suitable for contacting the contact pads, similar to the contact 319 discussed above with respect to FIGS. 3A-C.

The actuator 404 may be coupled to the contact element 402 at a point along the beam 416 on a side opposite the tip 418 with respect to the pivot point 410. The actuator 404 may be coupled to the beam 416, for example, by a structural element 406. The relative positions of the connection to the actuator and the pivot point and the tip along the beam, divides the beam into a first length $L_1$ measured between the tip 418 and the pivot point 410, and a second length $L_2$ measured between the pivot point 410 and the connection of the structural element 406. The relative dimensions of the lengths $L_1$, $L_2$, may be controlled to determine the amplification of the movement of the actuator 404 during operation.

For example, although shown as having the actuator 404 coupled to the shorter side of the beam 416, in some embodiments, the pivot point 410 may be positioned such that the actuator 404 may be coupled to the longer side of the beam 416. The mechanical advantage provided by the longer arm of the beam 416 relative to the pivot point 410 facilitates generating a larger actuation force on the switch contact (e.g., contact pads on signal paths 412, 414) with smaller forces generated by the actuator 404. Accordingly, a large motion, small force actuator (such as an electrostatic comb actuator, or the like) may be coupled to the beam 416.

Figure 5A:
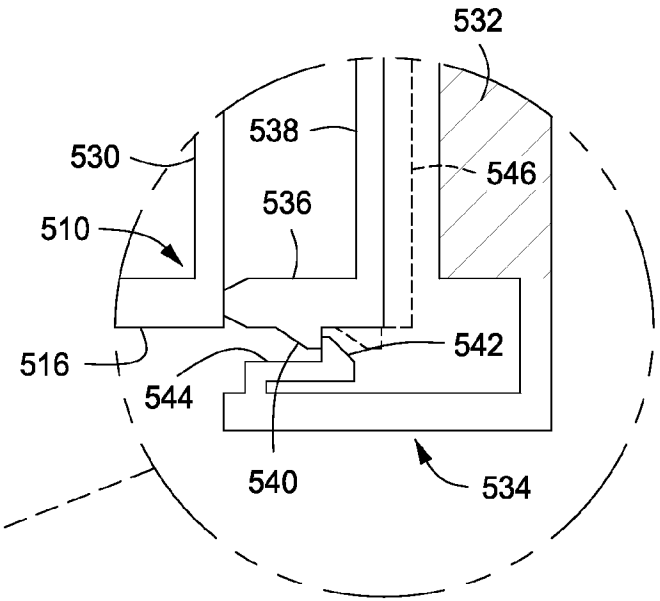
FIGS. 5 and 5A respectively depict depicts a schematic diagram of a MEMS switch in accordance with some embodiments of the present invention and a partial detail view thereof.
Figure 5:
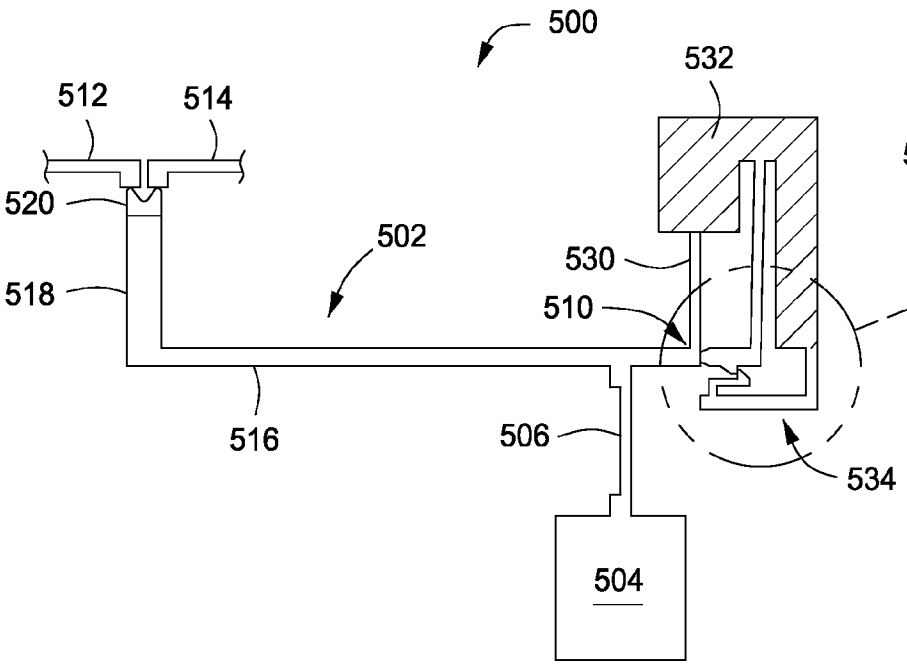

In addition to configurations such as described above with respect to FIG. 4, wherein movement of the actuator selectively closes the RF switch 400 (e.g., a normally open switch), embodiments are contemplated wherein a normally closed switch may be provided. For example, in some embodiments, and as shown in FIG. 5, a normally closed switch 500 is depicted having a beam 502 coupled to an actuator 504 via a structural element 506. A tip 518 may be disposed at one end of the beam 516 and may be normally disposed in contact with contact pads proximate respective ends of a signal path 512 and a signal path 514. Optionally, a contact 520 may be provided at the end of the tip 518 for making contact with the contact pads on the signal paths 512, 514. In some embodiments, the actuator 504 may be coupled to the beam 516 at a point disposed along the beam 516 between a pivot point 510 and the tip 518. A fixed structure 532 may be provided having a flexible extension 530 coupled to the beam 516 to provide a pivot point 510 about which the beam 516 may flex.

In some embodiments, a mechanism may be provided, such as locking element 534, to maintain the switch 500 in a normally closed position. As shown in FIG. 5A, in some embodiments, the locking element 534 may comprise a flexure 538 extending from the anchor structure 532 having a tip 536 and a locking feature 540 formed thereon. A mating flexible locking feature 542 may be provided via a flexure 544 extending from a portion of the fixed structure 532, or some other fixed structure, that meets with the locking structure 540 formed on the tip 536. The tip 536 may be formed to correspond with the switch 500 being in a normally open position (as shown in dotted lines at 546). The locking element 534 may be engaged by pushing the tip 536 forward to engage the locking features 540, 542 and retain the tip 534 in a forward position, whereby the tip 536 pushes the beam 516 to maintain a normally closed position.

Figure 6:
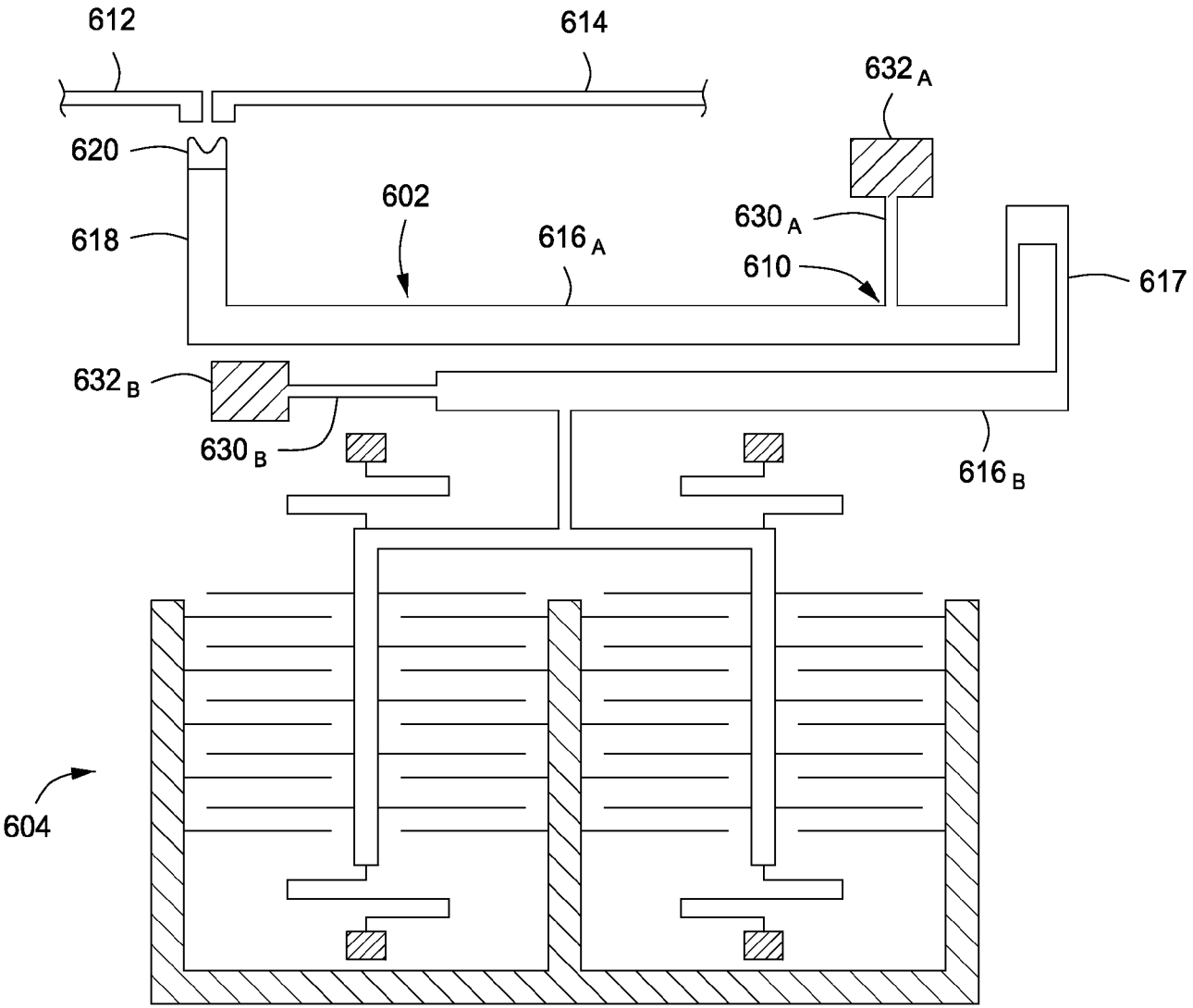
FIG. 6 depicts a schematic diagram of a MEMS switch in accordance with some embodiments of the present invention.

The above configurations as shown in FIG. 4 and FIG. 5 depict only some of the many variations of using anchored, pivoting beams coupled to an actuator for amplifying the movement of a tip of a contact element. Many other geometries and configurations may also be provided within the scope of embodiments of the present invention. For example, as shown in FIG. 6, a contact element 602 may be provided having dual beams $\mathbf{616}_A$ and $\mathbf{616}_B$ coupled together by a flexure 617 and respectively anchored at fixed structures $\mathbf{632}_A$ and $\mathbf{632}_B$ to an actuator 604. A tip 618 may be provided at an end of the beam $\mathbf{616}_A$. In operation, the movement of the actuator 604 (e.g., downward on the page, as illustratively shown with respect to FIG. 6) applies a force on beam $\mathbf{616}_B$ which, in turn, applies a force to one end of the beam $\mathbf{616}_A$ via the flexure 617, causing the beam $\mathbf{616}_A$ to rotate about the pivot point 610, thereby causing the tip 618 and/or contact 620 to come into contact with contacts along signal paths 612 and 614. Although sown in one particular configuration, any actuator could be used in place of actuator 604, it is sufficient that the actuator cause the movement of $\mathbf{616}_B$ from a first position to the second position.

Figure 7:
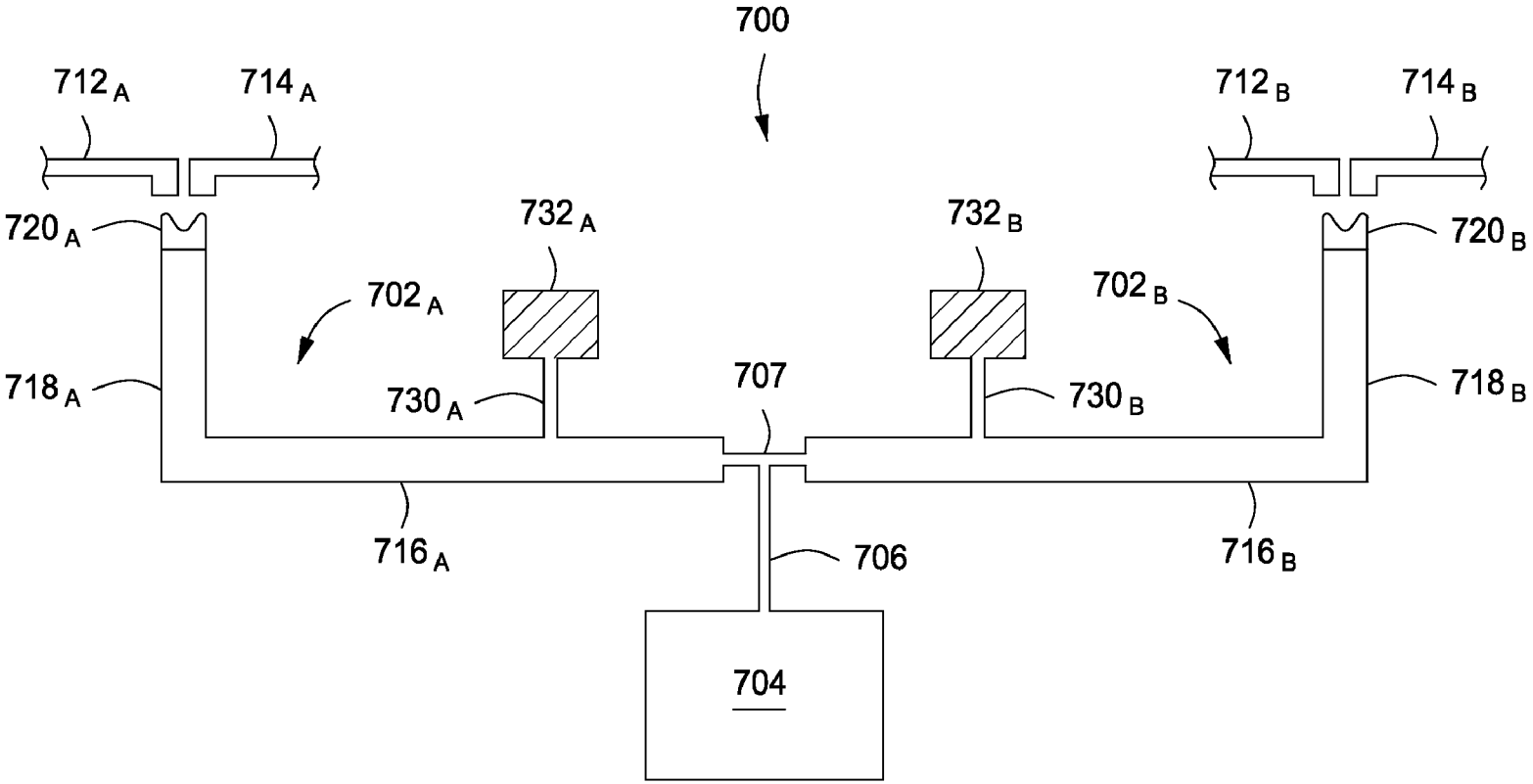
FIG. 7 depicts a schematic diagram of a MEMS switch in accordance with some embodiments of the present invention.

In addition to the various embodiments described above with respect to FIGS. 4 through 6, various configurations of the switch may be provided for opening and closing multiple switches or providing control over multiple switches with a single actuator. For example, FIG. 7 depicts a single-pole, double-throw switch 700 generally similar to switch 400 as described above with respect to FIG. 4. However, the actuator is coupled to two beams 716A and 716B via a flexure 717 to allow for simultaneous control over switches 702A and 702B.

Embodiments of the present invention further may include multi-stage spring systems that provide variable spring compliance to shape the mechanical characteristics of the spring system. Such multi-stage spring systems may advantageously provide an increased restoring force for assisting in overcoming any contact stiction that may occur between the contacts that the switch engages upon closing as compared to conventional spring systems. For example, conventional spring systems are typically linear and have a k value that is low enough to accommodate the low electrostatic force that is initially generated when used with electrostatic actuators (e.g., to allow the switch to begin to close when the gap between the electrodes of the electrostatic actuator is large). In addition, such multi-stage systems may further facilitate storing restoring forces that may increase as a function of the reduction in the gap between electrodes of an electrostatic actuator (which increases the electrostatic force between the electrodes), thereby further facilitating overcoming any contact stiction that may develop between the electrodes and/or the contacts of the switch (as compared to conventional systems having low, constant mechanical restoring forces due to the linear spring resulting in lesser ability of contact-breaking for a MEMS switching device utilizing such conventional spring systems).

In some embodiments, the mechanical characteristics of the spring system may be shaped to conform to forces applied by an actuating means coupled to the multi-stage spring system. The multi-stage spring system may offer different compliant levels at different deflection locations. In a non-limiting example, the multi-stage spring system may be utilized to provide a compact, high-density, low-voltage MEMS switch. For example, the multi-stage spring system can be used as part of, or in conjunction with, a MEMS electrostatic actuator (such as the actuators disclosed herein) for various applications, including RF switches. In some embodiments, a MEMS switch may be formed using the multi-stage spring system as part of, or in conjunction with, a MEMS electrostatic actuator having movement parallel to the plane of a substrate on which the switch is disposed. The multi-stage spring system may advantageously provide higher contact-breaking forces as compared to conventional designs in such a MEMS switching device, or other applications as well.

The multi-stage spring systems disclosed herein may sometimes be referred to as multi-stage springs or multi-stage spring assemblies. In some embodiments, the multi-stage spring (or multi-stage spring assembly) may include a plurality of spring elements for providing varying spring constants (k values) corresponding to varying quantities, or distances, of deflection of the spring. As such, the multi-stage spring assembly may have a first spring constant when deflected up to a first distance (e.g., a first stage), a greater, second spring constant when deflected beyond the first distance and up to a second distance (e.g., a second stage), and a greater, third spring constant when deflected beyond the second distance and up to a third distance (e.g., a third stage), and so on for embodiments having greater numbers of spring elements or stages. Each individual stage of the multi-stage spring may have any desired k value such that the total k value at each stage and over the entire range of movement of the multi-stage spring may be controlled as desired. The multi-stage springs in accordance with the various embodiments disclosed herein may have greater or fewer spring elements than those illustratively shown.

Figure 8A:
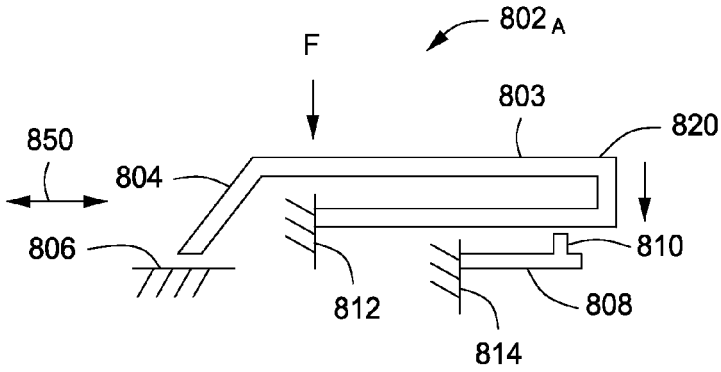
FIGS. 8A-C depict schematic diagrams of multi-stage springs in accordance with some embodiments of the present invention and suitable for use in a MEMS switch in accordance with some embodiments of the invention.

FIG. 8A depicts a schematic side view of a multi-stage spring 802A in accordance with some embodiments in the present invention. In the embodiment depicted in FIG. 8A, the multi-stage spring 802A includes a first spring element 803, a second spring element 808, and a third spring element 804. The spring elements may take any suitable form such as simple, or linear (e.g., such as second spring element 808), complex, or non-linear (e.g., such as first spring element 803), curved, combinations of the above, or the like. The spring elements may be anchored at any desired location (as illustratively shown by hash marks in FIG. 8A at 812 and 814) to provide the relative movement of the respective spring elements and the engagement thereof during operation.

The various spring elements (e.g., 803, 804, 808 in the embodiment depicted in FIG. 8A) of the multi-stage spring may be configured to be at least partially sequentially engaged upon deflection of a first spring element in order to provide increasing k values for the multi-stage spring as a whole as the first spring element travels across an increasing range of deflection. The deflection of the respective spring elements may be controlled via application of a force (depicted in the Figures herein as an arrow labeled "F" for illustration) to the multi-stage spring. Such a force may be provided by single or composite sources (such as by one or more of the actuators described herein) and is only illustratively shown in the Figures. The force may be applied at any suitable location and in any suitable direction to provide the desired motion (e.g., deflection) of the respective spring elements of the multi-stage spring. For example, although shown in a single location in FIGS. 8A-C, the force F may be applied at different locations, or at multiple locations, anywhere on the multi-stage spring to provide the desired motion of the respective spring elements of the multi-stage spring. The multi-stage spring assembly stores mechanical energy when deflected towards a contact surface that biases the spring assembly away from the contact surface when released.

For example, in some embodiments and as depicted in FIG. 8A, the second spring element 808 may be configured to be engaged upon a desired quantity of deflection of the first spring element 803 (e.g., the force applied to the first spring element 803 may cause a downward deflection of the first spring element 803, including at an end 820 of the first spring element 803, thereby causing the first spring element 803 to contact the second spring element 808). The second spring element 808 may have an extension 810 or other feature that engages the first spring element 803 after a desired quantity of deflection of the first spring element 803. The extension 810, or other feature, may be configured to define a small gap between the first spring element 803 and the second spring element 808 such that the second spring element 808 is engaged upon the desired quantity of deflection of the first spring element 803. In operation, the first spring element 803 initially provides the multi-stage spring $\mathbf{802}_A$ with an initial k value (k1). Upon engaging the second spring element 808 (or the extension 810), a second k value (k2) for the multi-stage spring $\mathbf{802}_A$ is provided. The second k value will be equal to an increased k value of the first spring element 803 (due to its effective shortening) plus the k value of the second spring element 808.

The third spring element 804 may be configured to be engaged upon a second quantity of deflection of the first spring element 803 beyond the first quantity of deflection (e.g., after a desired quantity of deflection after engagement of the second spring element 808). Thus, a third k value (k3) for the multi-stage spring $\mathbf{802}_A$ may be provided upon engagement of the third spring element 804. Each spring element may be configured to provide an increase in the k value of the multi-stage spring as desired for a particular application (including greater of fewer stages, varying ranges of deflection for individual stages and/or for the multi-stage spring as a whole, or the like).

In some embodiments, the third spring element 804 may engage a contact surface of a member 806. A portion of the third spring element 804 (or whichever final spring element ultimately engages the member 806) may be configured to wipe the member 806, as shown be arrows 850 (e.g., the portion of the third spring element 804 that contacts the member 806 may be configured to move with respect to the contact surface of the member 806 as the deflection increases and decreases to "wipe" the contact surface of the member 806). The wiping, and subsequent unwiping motion upon retraction of the multi-stage spring $\mathbf{802}_A$, may facilitate overcoming any contact stiction between the member 806 and the portion of the third spring element 804 that contacts the member 806. The wiping motion may further facilitate breaking through any oxide layer or particles or other contaminants that may exist between the member 806 and the portion of the third spring element 804 that contacts the member 806, which may improve the operation of the switch (e.g., signal quality for electrical applications, switch lifetime, or the like).

In some embodiments, the spring element configured to wipe the member 106 may be angled with respect to the member 806 to provide the wipe. Although the third spring element 804 depicted in FIG. 8A is shown at an about 45 degree angle with respect to the member 806, other angles may be utilized to facilitate control of the k value provided by the spring element and/or control of the amount of travel of the spring element when deflected beyond initial contact with the member 806 (e.g., to control the amount of wipe provided).

In some embodiments, as shown in FIG. 8A, the member 806 may be a separate component that is disposed with respect to the multi-stage spring $\mathbf{802}_A$ to facilitate contact of the third spring element 804 (or a subsequent spring in embodiments with greater numbers of spring elements) upon a desired quantity of deflection of the multi-stage spring $\mathbf{802}_A$. In some embodiments (not shown), the member 806 may be part of the multi-stage spring $\mathbf{802}_A$.

The quantity of deflection of the multi-stage spring $\mathbf{802}_A$, or of the first spring element 803, may be controlled via application of a force (indicated by arrow F in FIG. 8A) to deflect the first spring element 803. The magnitude of the force applied may be selectively controlled to provide a desired quantity of deflection given the design of the multi-stage spring and the varying stages of k values provided by the multi-stage spring assembly as it deflects. The force may be applied via any suitable mechanism, such as an actuator. In some embodiments, the force may be applied by a MEMS actuator as discussed in more detail below. Although shown as being applied proximate a distal end of the first spring element 803, the force may be applied at any suitable location of the multi-stage spring $\mathbf{802}_A$ for inducing deflection of the first spring element 803.

Figure 8B:
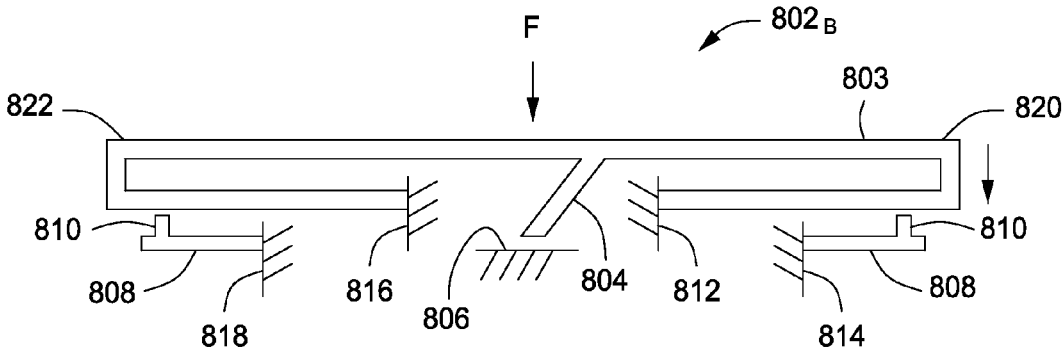

Embodiments of the multi-stage spring disclosed herein may have various forms. For example, the number of spring elements and/or stages of the multi-stage spring may be selected as desired to control the k value of the multi-stage spring, and thereby to increase the stored mechanical energy upon deflection of the multi-stage spring. For example, FIG. 8B illustrates embodiments of a multi-stage spring $\mathbf{802}_B$ wherein the spring elements have a different configuration. Specifically, as shown in FIG. 8B, the first spring element 803 of the multi-stage spring $\mathbf{802}_B$ may be anchored at two points (812, 816) and may be configured to deflect upon application of a force, F, to a central location (or any other suitable location or locations) on the first spring element 803. A pair of second spring elements 808 may be provided to be engaged upon a desired quantity of deflection of the first spring element 803 (e.g., as respective ends 820, 822 of the first spring element 803 deflect toward the second spring elements 808). A third spring element 804 may be provided for being engaged upon a desired continued amount of deflection of the first spring element 803. The configuration shown in FIGS. 8A and 8B are illustrative only and, as discussed above, many other configurations are contemplated.

In addition, the multi-stage spring may be utilized in various applications, such as electrical systems, mechanical systems, electromechanical systems, or the like. For example, a multi-stage spring in accordance with embodiments of the present invention may be utilized as a resilient contact element for making selective temporary electrical pressure contacts with a contact element. A non-limiting example of one such use may be illustrated using a multi-stage spring as shown in FIGS. 8A-B, wherein the member 806 may provide a first conductive path and the first spring element 803 and the third spring element 804, or portions thereof, may provide a second conductive path for making selective contact with the member 806 upon sufficient deflection of the first spring element 803 (and thereby, the third spring element 804). The second electrically conductive path may be insulated from the first electrically conductive path when the third spring element 804 is not in contact with the member 806. Accordingly, the multi-stage springs $\mathbf{802}_{A\text{-}B}$ may be utilized as a switch for selectively making electrical contacts (e.g., between the third spring element 804 and the member 806).

Figure 8C:
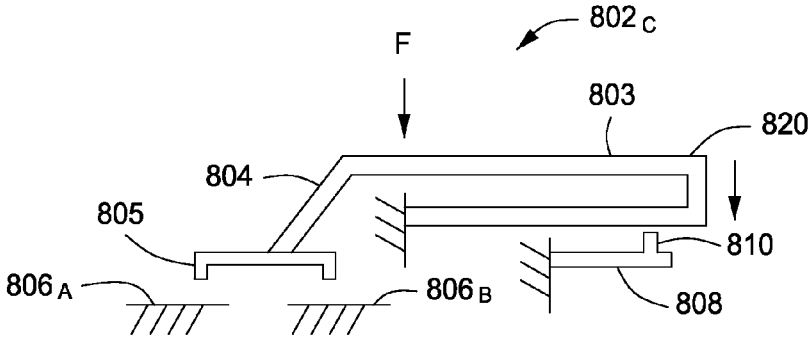

In some embodiments, as shown in FIG. 8C, a multi-stage spring $\mathbf{802}_C$ may be provided for making selective contact between a contact surface of a first member $\mathbf{806}_A$ and a contact surface of a second member $\mathbf{806}_B$. In some embodiments, such contact may be utilized to provide an electrical switch. For example, the first member $\mathbf{806}_A$ and the second member $\mathbf{806}_B$ may be at least partially fabricated from one or more electrically conductive materials to provide an electrical pathway that is open when the switch is open (e.g., when the multi-stage spring is relaxed.) The multi-stage spring $\mathbf{802}_C$ may be similar to the multi-stage springs $\mathbf{802}_A$, $\mathbf{802}_B$ described in FIGS. 8A-B with the addition of a tip 805 disposed on the third spring element 804 (or whichever ultimate spring element is desired to make contact with the members $\mathbf{806}_A$, $\mathbf{806}_B$.). The tip 805 may be configured to contact both members $\mathbf{806}_A$, $\mathbf{806}_B$ upon sufficient deflection of the multi-stage spring $\mathbf{802}_C$. In some embodiments, the tip 805 may also be configured to wipe both members $\mathbf{806}_A$, $\mathbf{806}_B$ upon deflection of the multi-stage spring $\mathbf{802}_C$ beyond initial contact with the members $\mathbf{806}_A$, $\mathbf{806}_B$.

Figure 9B:
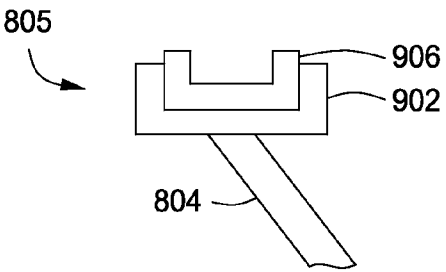
FIGS. 9A-B depict non-limiting examples of contacts suitable for use with multi-stage springs in accordance with some embodiments of the invention.
Figure 9A:
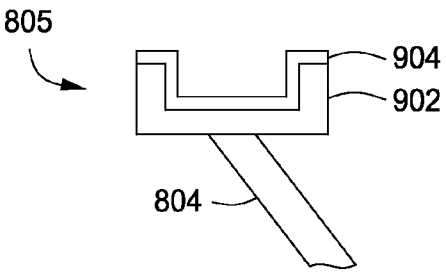

In embodiments where electrical contact is desired, the tip 805 may be fabricated from one or more conductive materials, may be coated with one or more conductive materials, or may have an electrically conductive portion coupled to the tip 805. For example, FIG. 9A depicts an illustrative schematic side view of a tip 805 in accordance with some embodiments of the invention. In the embodiment shown in FIG. 9A, the tip 805 includes a base 902 disposed at an end of the third spring element 804. The tip 805 further includes a conductive portion 904 configured to contact both members $\mathbf{806}_A$, $\mathbf{806}_B$ (as shown in FIG. 8C). The conductive portion 904 may be a conductive coating (such as a deposited or plated coating), a thin sheet or foil that may be coupled to the base 902, a thin conductive plate that is machined or bent to correspond to the geometry of the base 902, or like material and configuration suitable for conducting electrical current in a desired application. In some embodiments, as shown in FIG. 9B, a conductive portion 906 configured to contact both members $\mathbf{806}_{A\text{-}B}$ may be disposed in a corresponding recess in the base 902. The conductive portion 906 may comprise one or more pieces of conductive material that is machined or otherwise formed into a desired shape suitable for contacting members $\mathbf{806}_{A\text{-}B}$. The geometry of the tip 805 (including the base 902, the conductive portion 904, and/or the conductive portion 906) shown herein is illustrative only and other geometries are contemplated for either or both of the contact and non-contact portions of the tip 805, such as curves, chevrons (vees), or the like.

Figure 10C:
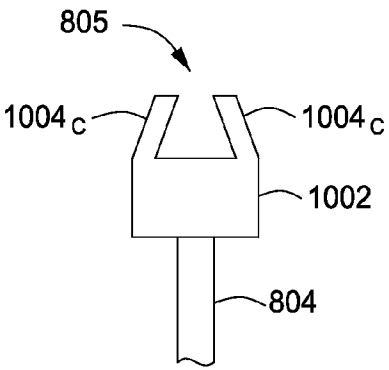
FIGS. 10A-C depict non-limiting examples of tips suitable for use with multi-stage springs in accordance with some embodiments of the invention.
Figure 10B:
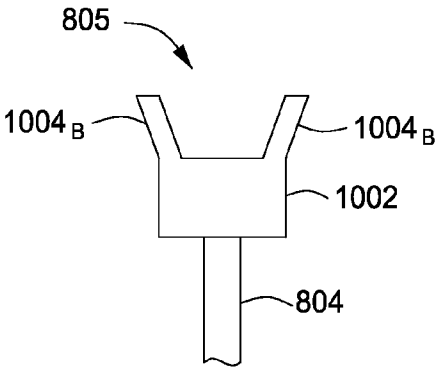
Figure 10A:
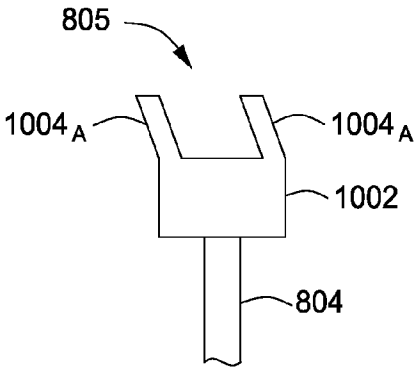

In some embodiments, the wipe of the members by the multi-stage spring may be provided by elements other than the final spring element of the multi-stage spring. For example, in some embodiments, the tip 805 may be disposed at an end of a spring element (such as the third spring element 804) that is not configured to wipe the members $\mathbf{806}_A$, $\mathbf{806}_B$ (shown in FIG. 8C) upon continued deflection past initial contact therewith. In some embodiments, the tip 805 itself may be configured to provide the desired wipe motion. For example, FIGS. 10A-C depict non-limiting examples of tips 805 suitable for use with multi-stage springs in accordance with some embodiments of the invention. In embodiments represented by FIG. 10A, the tip 805 may include a base 1002 having two contacts $\mathbf{1004}_A$ that are each angled with respect to the respective member 806A, 806B with which the contact $\mathbf{1004}_A$ will engage. Similarly, as shown in FIG. 10B, the base 1002 may include two contacts $\mathbf{1004}_B$ that are angled in outwardly opposing directions. In some embodiments, as shown in FIG. 10C, the base 1002 may include two contacts $\mathbf{1004}_C$ that are angled in inwardly opposing directions. In some embodiments, the non-limiting examples of tip configurations shown in FIGS. 10A-C may be combined with the non-limiting examples of the contacts depicted in FIGS. 9A-B. It is contemplated that still other combinations of tip configurations, contacts, and spring configurations may also be utilized to provide a multi-stage spring in accordance with the teachings of the present invention.

Figure 11A:
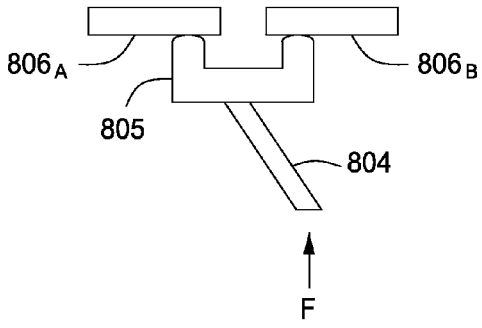
FIGS. 11A-B depict stages of operation of a multi-stage spring having a tip configuration in accordance with some embodiments of the present invention.
Figure 11B:
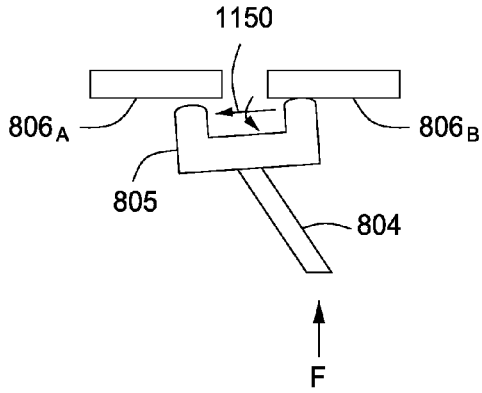

In some embodiments, the multi-stage spring may have a tip configuration that may provide more even contact between multiple contact points (such as between a tip similar to the tip 805 and members $\mathbf{806}_{A\text{-}B}$). For example, in some embodiments, and as depicted in FIG. 11A, the tip 804 of the multi-stage spring (such as in embodiments similar to FIG. 8C) may initially come into contact with the members $\mathbf{806}_{A\text{-}B}$ substantially concurrently, or the tip 805 may provide substantially equal pressure against both members when a force, F, is applied to the multi-stage spring to cause it to come into contact with the members $\mathbf{806}_{A\text{-}B}$. As the force is increased, or as the wiping movement begins, increasingly higher contact force will be applied on member $\mathbf{806}_B$, and less on member $\mathbf{806}_A$ as the entire tip 805 wipes and rotates (as shown by arrows 1150), thereby causing contact resistance variation between the members $\mathbf{806}_{A\text{-}B}$. In some embodiments, and as depicted in FIG. 11B, the tip 805 may rotate sufficiently to disengage, or lose contact with, member $\mathbf{806}_A$.

Figure 12A:
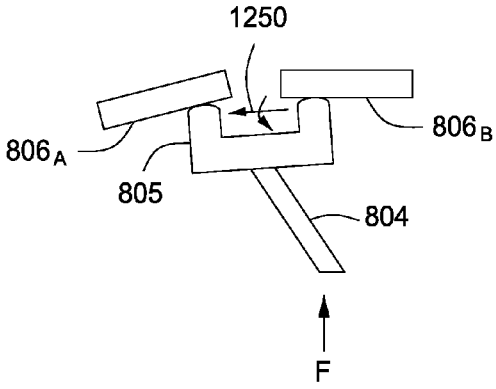
FIGS. 12A-B respectively depict various tip configurations of a multi-stage spring in accordance with some embodiments of the present invention.

In some embodiments, one or more of the tip 805, the member $\mathbf{806}_A$, and/or the member $\mathbf{806}_B$ may be configured to compensate for the wipe and/or rotation of the tip 805 (as shown by arrows 1250). For example, in some embodiments, and as shown in FIG. 12A, the member $\mathbf{806}_A$ may be provided at an angle configured to account for the rotation of the tip 805, which may facilitate making the resultant contact forces more even between the two members $\mathbf{806}_{A\text{-}B}$. Providing the member $\mathbf{806}_A$ at an angle may also advantageously facilitate keeping even contact along the surface of the members $\mathbf{806}_{A\text{-}B}$ as the tip 805 provides wipe of the respective surfaces of the members $\mathbf{806}_{A\text{-}B}$.

Figure 12B:
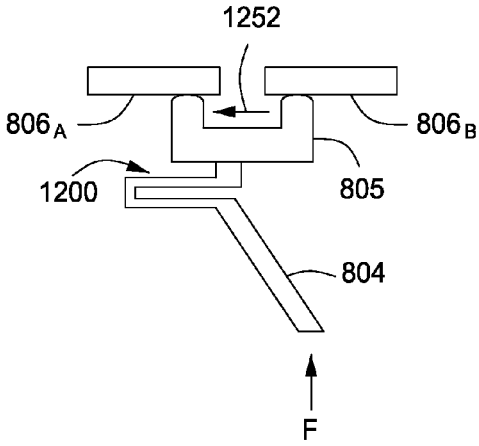

In some embodiments, a mechanism may be provided to facilitate rotation, or pivoting, of the tip 805 (and/or one or more of the members $\mathbf{806}_{A\text{-}B}$) while maintaining relatively even contact pressure between the tip 805 and the members $\mathbf{806}_{A\text{-}B}$ as the tip 805 wipes the members $\mathbf{806}_{A\text{-}B}$ (as shown by arrow 1252). Examples of suitable mechanisms include hinges, flexures, springs, or the like. In some embodiments, the k value, if any, of the mechanism may provide an additional stage in the range of movement of the multi-stage spring (e.g., the multi-stage spring while have a certain cumulative k value before and after engagement of the mechanism). The mechanism may be provided at any suitable location in the multi-stage spring or in the members. For example, in some embodiments, and as depicted in FIG. 12B, a spring 1200 may be provided to facilitate rotation of the tip 805 and maintain more even contact pressure between the tip 805 and the members $\mathbf{806}_{A\text{-}B}$. Although shown disposed in the third spring element 104, the spring 1200 (or other mechanism) may be disposed in other locations as well, such as in the tip 805, in one or more of the members $\mathbf{806}_{A\text{-}B}$, or the like.

The components, or elements, of the multi-stage spring assemblies disclosed herein may be fabricated from any suitable materials that may provide the desired characteristics for which the various assembly components provide. For example, the spring elements may be fabricated from materials providing the desired k values and range of motion of the individual spring elements without damaging the assembly. In addition, where the multi-stage spring assemblies are used to make electrical contacts, such as in switching applications, the multi-stage spring assembly may be at least partially fabricated from (including coated with) suitable conductive materials, such as metals, noble metals, or semi-noble metals (e.g., copper, aluminum, gold, rhodium, palladium, alloys thereof, or the like). For example, in some embodiments, the multi-stage spring assembly may be at least partially fabricated from silicon, or in some embodiments, single crystal silicon. In some embodiments, the multi-stage spring assembly may be lithographically fabricated from silicon. In some embodiments, the multi-stage spring assembly may be partially lithographically fabricated from silicon and the tip (e.g., 804, 805) may be formed from a metal by a suitable process, such as plating, or the like.

As described above with respect to FIGS. 8A-C, multi-stage springs in accordance with embodiments of the invention may provide stages of increasing k values over a desired range of deflections of the multi-stage spring. Such incremental increases in k values at desired stages of deflection of the spring may advantageously be utilized to store increased quantities of mechanical energy in the multi-stage spring assembly when the force applied to actuate the multi-stage spring is increases exponentially. Such exponentially increasing forces may be obtained when using, in a non-limiting example, a gap closing electrostatic actuator to apply the force to drive the spring. Of course, any of the multi-stage springs 8A-C can be used with any actuator and any tip (described herein). Moreover, FIGS. 8A-C illustrate only exemplary multi-stage springs, and other configurations are possible that fall within the scope of the described invention.

Figure 13:
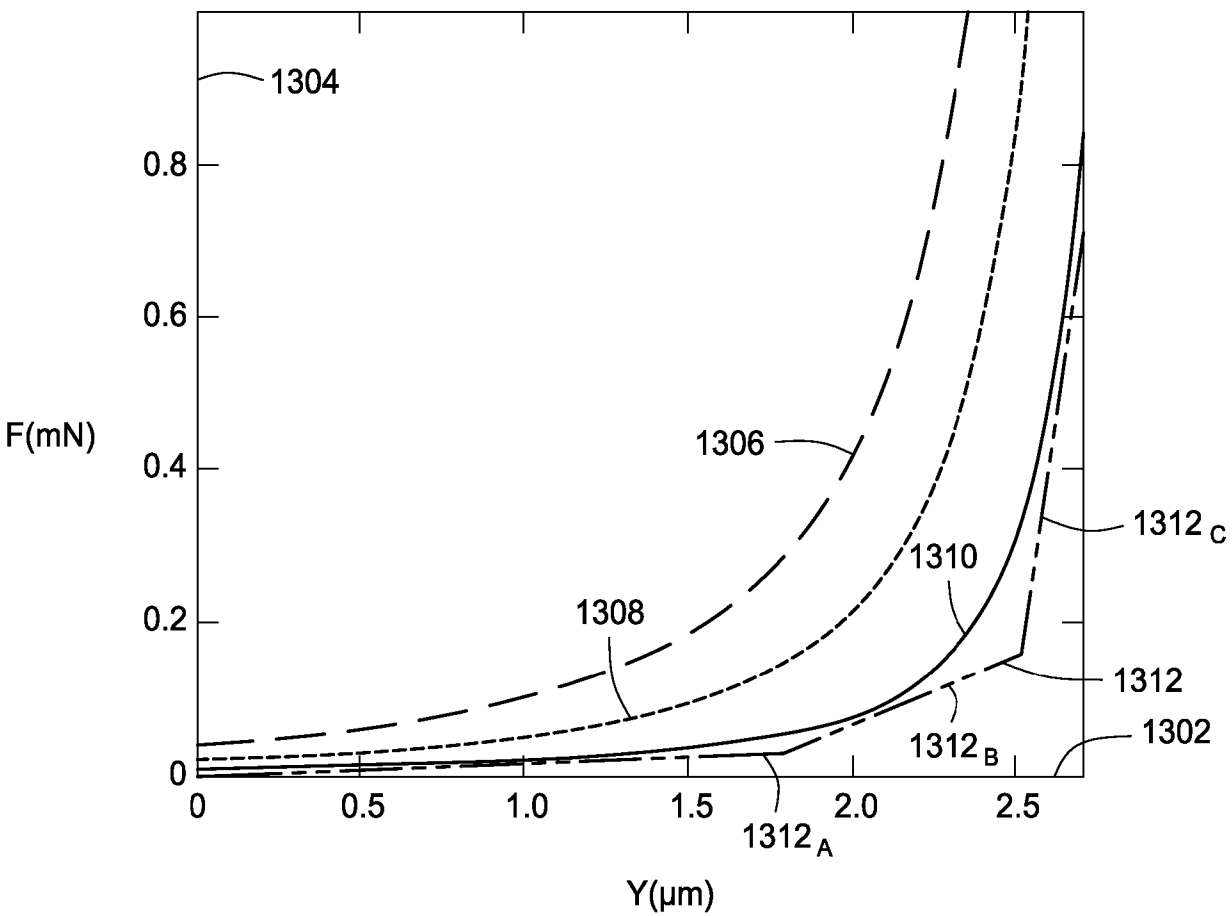
FIG. 13 depicts a graph showing force versus distance traveled for a multi-stage spring in accordance with some embodiments of the invention.

For example, FIG. 13 depicts a graph showing the force in millinewtons (axis 1304) versus the distance traveled, y, in micrometers (axis 1302) for an electrostatic actuator having a variety of voltages applied (a first voltage shown by 1306, a second voltage shown by 1308, and a third voltage shown by 1310) and an exemplary multi-stage spring assembly (1312). As shown by lines 1306, 1308, and 1310 the electrostatic force generated by a gap-closing actuator increases exponentially as the gap closes (e.g., as the actuator moves a longer distance as the electrodes approach a closed position).

As shown illustratively with respect to line 1310, the mechanical force generated, or stored as potential energy within the multi-stage spring, may be advantageously made to more closely follow the curve of the electrostatic force generated by the actuator (e.g., line 1310 in this illustration). For example, a portion $\mathbf{1312}_A$ corresponds to the deflection of a first stage or spring element, portion $\mathbf{1312}_B$ corresponds to the engagement of a second stage or spring element, and portion $\mathbf{1312}_C$ corresponds to the engagement of a third stage or spring element. As can be readily seen from extension of the portion $\mathbf{1312}_A$, a spring or spring assembly having a linear k value over the desired range of travel would generate and store much less energy within the spring.

The line 1312 shown in FIG. 13 is illustrative of some embodiments of a multi-stage spring. Greater numbers of stages or spring elements may be implemented in a multi-stage spring in order to more closely follow the curve of the actuator force applied over the same range of travel (e.g., to more closely trace the force applied by the actuator). Thus, the multi-stage spring may provide a significant advantage as compared to single-stage linear springs conventionally used with electrostatic gap-closing actuators—embodiments of multi-stage springs as disclosed herein may advantageously store a greater magnitude of restoring force to facilitate overcoming contact stiction between contacts, for example, when used in switching applications.

As discussed above, the multi-stage spring assemblies in accordance with some embodiments of the invention may be utilized with an actuator to control the operation thereof (e.g., to control the deflection of the multi-stage spring). Examples of suitable actuators may be electrically, mechanically, or electromechanically driven and may vary in size to suit the application. In some embodiments, the actuator may be a micro-electromechanical system (MEMS) device, such as an electrostatic gap closing actuator, a comb drive, combinations thereof, or the like. Non-limiting examples of suitable MEMS actuators, such as electrostatic gap closing actuators, comb drives, angled gap closing actuators, partitioned MEMS actuators, or multi-stage MEMS actuators, are described in more detail below.

Actuator Examples

As discussed above, MEMS switches in accordance with embodiments of the present invention may be utilized with various actuating mechanisms to control the operation of the switch (e.g., any actuator provided herein may be used with any of the springs, contact elements, switches, or the like, in accordance with the teachings disclosed herein). Such actuators may be conventional, such as certain MEMS comb-drive or gap closing electrostatic actuators, or the like. In addition, in some embodiments, inventive MEMS comb-drive or gap closing electrostatic actuators may be provided, alone or in combination, with the embodiments of springs and contact arrangements as discussed above.

For example, conventional MEMS electrostatic actuator designs typically use one of either parallel-plate or comb actuating mechanisms. MEMS parallel-plate mechanisms provide a force characteristic that is inversely proportional to the square of a remaining gap distance between two parallel plate electrodes. This arrangement provides an electrostatic force that is very strong only when the gap between the plates is small. In contrast, MEMS comb actuators typically provide a larger travel distance with a force characteristic that is constant to the first order with respect to the travel distance of the actuator. However, the force provided by a comb actuator is smaller in comparison to the parallel-plate force when the gap is small. Consequently, such actuators provide either high-force and low travel distance (in the parallel-plate case), or low-force and larger travel distance (in the comb case).

Figure 14:
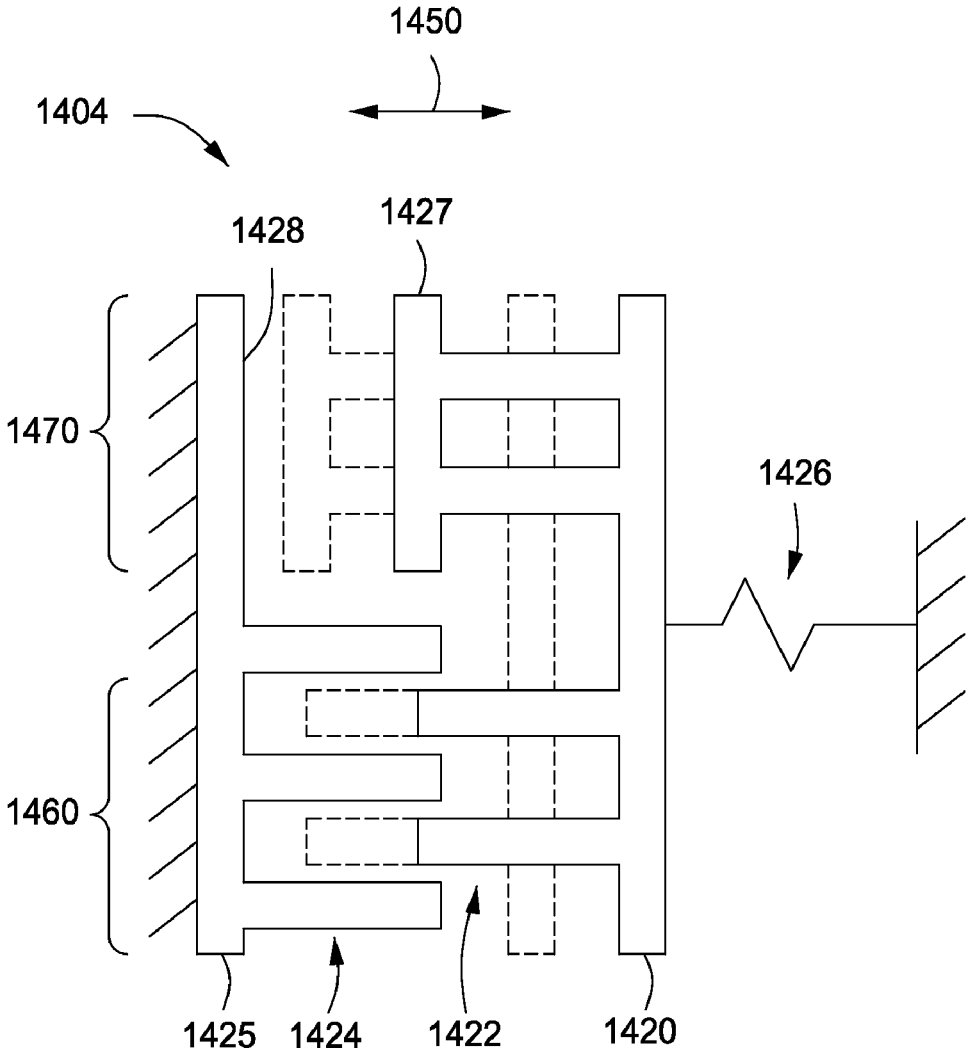
FIG. 14 depicts an actuator suitable for use in MEMS switches in accordance with some embodiments of the invention.

FIG. 14 depicts a partitioned electrostatic actuator 1404 that may include at least two actuating mechanisms according to some embodiments of the invention. The at least two actuating mechanisms may be the same or different and may be configured to operate together to provide an increased actuation force for a given range of travel of the actuator. In some embodiments, both comb and parallel-plate MEMS electrostatic actuating mechanisms may be provided in a single actuator, such that the comb actuator portion provides a large travel distance that moves the parallel-plate actuator portion to a small gap distance, at which point the parallel-plate actuator becomes dominant in producing a high level of electrostatic force.

For example, in some embodiments, the partitioned electrostatic actuator 1404 may include a comb drive electrostatic actuator 1460 and a parallel plate, or gap-closing, electrostatic actuator 1470. The combination of the comb drive and gap-closing actuators may facilitate providing a larger range of motion characteristic of the comb drive actuator along with a greater actuation force characteristic of the gap-closing actuator.

In some embodiments, a movable frame 1420 may be provided having a plurality of movable electrodes 1422 extending therefrom in a region corresponding to the comb drive electrostatic actuator 1460 and a movable parallel plate electrode 1427 extending therefrom in a region corresponding to the gap closing electrostatic actuator 1470. The movable frame 1420 may be movable in a direction as shown by arrows 1450. A fixed frame 1425 may be provided having a plurality of fixed electrodes 1424 extending therefrom in an opposing, interleaved configuration with the plurality of movable electrodes 1422 within the region corresponding to the comb drive electrostatic actuator 1460 and a flat region 1428 generally opposed with the parallel plate 1427 in the region corresponding to the gap-closing electrostatic actuator 1470. A spring 1426 may be provided (for example, coupled to the movable frame 1420) to store a restoring force that may facilitate returning the actuator 1404 to an open position. The spring 1426 is simply representative of various spring shapes and/or configurations which are contemplated.

In operation, a voltage potential may be applied to the actuator 1404. Initially, the gap between the gap-closing electrostatic actuator portion 1470 is large and, therefore, the attractive force is small. However, the comb drive portion 1460 of the actuator 1404 operates to bring the movable electrode 1427 of the gap-closing electrostatic actuator 1470 closer to the opposing fixed electrode 1428, at which point the increased force of attraction between the electrodes 1427 and the fixed portion 1425 provides a high force of attraction. Thus, the actuator 1404 may advantageously provide a large travel distance as well as a high force at the end of the displacement range.

The force-displacement characteristic of a normal parallel plate, or gap-closing electrostatic actuator is flat in the initial displacement regime and steep in the final displacement regime (e.g., the change in the attractive force is small initially when the gap between opposing electrodes is larger, but rapidly increases as the gap between the opposing electrodes nears the minimum; see, for example, FIG. 13). This characteristic limits the potential wiping motion applied by a switch due to the large attractive force being generated mainly over a small range of motion. This constraint may be ameliorated by, for example, higher voltages, larger actuator areas, and/or using higher energy actuators, but these solutions are limited by product requirements. Ultimately, control of the gap distance is a powerful parameter to attain a high force, but it limits the application of a wipe motion by a contact element coupled to the actuator.

To overcome this deficiency, and to attain both high force and large displacement, a parallel plate gap-closing actuator may be provided having the opposing electrodes rotated at an angle with respect to the direction of movement. Rotating the electrodes relative to the direction of movement allows a narrower gap to be provided between adjacent electrodes. The narrower gap allows for higher energy actuator, which in turn outputs a higher force. The factor of improvement is approximately $1/\cos\theta$ relative to normal parallel plate actuator.

Figure 15A:
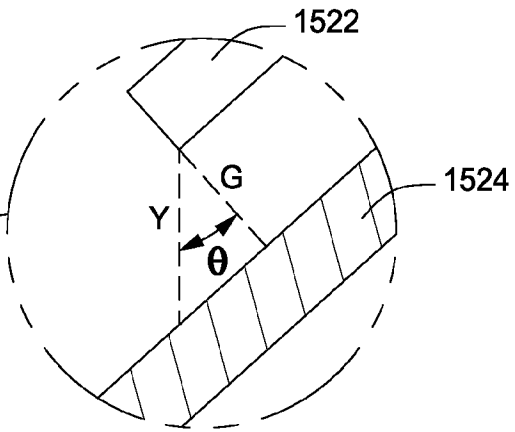
FIGS. 15-15A respectively depict an actuator suitable for use in MEMS switches in accordance with some embodiments of the invention and a partial detail thereof.
Figure 15:
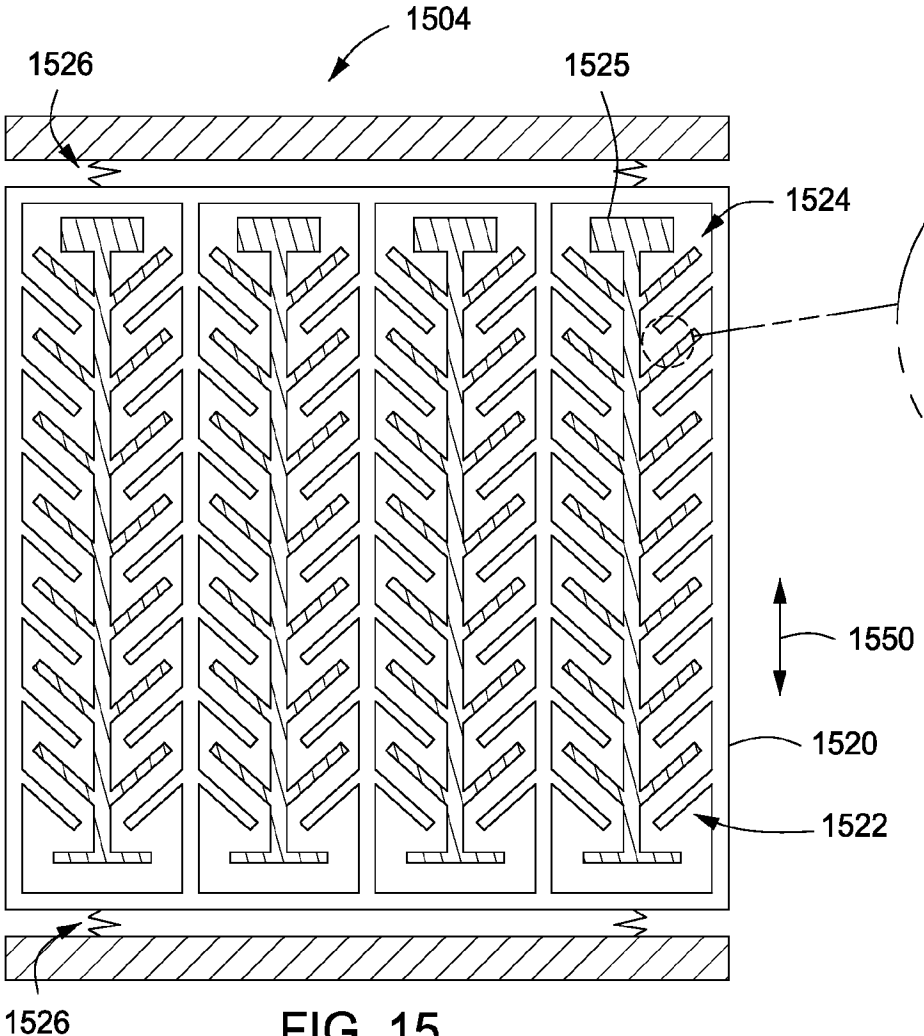

For example, FIG. 15 depicts an angled parallel plate actuator 1504 similar to the gap closing actuator discussed above with respect to FIG. 2, however, having angled electrodes that may provide a larger range of motion of the actuator 1504 and/or that may provide a higher attractive force. In some embodiments, a movable frame 1520 may be provided having a plurality of movable electrodes 1522 extending therefrom at a non-perpendicular angle with respect to the direction of movement of the actuator 1504 (indicated by arrows 1550). A fixed structure 1525 may be provided to support a plurality of fixed electrodes 1524 in an orientation that is generally parallel with the plurality of fixed movable electrodes 1522 and interleaved therewith such that by providing a voltage differential to the fixed and movable electrodes 1524, 1522, motion of the actuator 1504 may be controlled.

As shown in more detail in FIG. 15A, a distance y in the direction of movement is greater than the normal distance, or gap g, between the respective pairs of electrodes 1522, 1524 due to the non-perpendicular angle of the electrodes with respect to the direction of movement. Specifically, the y-motion traveled upon closing the actuator 1504 (e.g., due to the closing of the gap between the electrodes 1522, 1524) will be equivalent to the gap g divided by the cosine of the angle $\theta$ (defined between the direction of travel, y, and the perpendicular extending between the respective electrodes). As such, for a given voltage potential applied, the actuator 1504 provides the benefit of an actuator having a smaller gap (generating higher electrostatic attractive forces) in combination with a longer range of motion (as compared to conventional actuators providing similar attractive forces at similar voltages). The angle of the electrodes may be adjusted to provide a balance between the range of motion and the force generated. For example, a lesser angle (e.g., a smaller $\theta$, as shown in FIG. 15A) will provide a lesser range of motion, y, while a greater angle (e.g., a larger $\theta$, as shown in FIG. 15A) will provide a greater range of motion, y.

The symmetric configuration of the opposing electrodes (e.g., fixed electrodes 1524 and movable electrodes 1522) on either side of the fixed structure 1525 can provide stability of the actuator 1504 by balancing the forces generated non-parallel to the direction of movement. In addition, the utilization of restoring springs 1526 may further provide stability of the actuator 1504 while further facilitating returning the actuator 1504 to an open position when the voltage potential for actuation is removed.

The length of the movable frame 1520 and fixed structure 1525, and the number of opposing electrodes extending therefrom, may be controlled to generate a desired force for a given actuation voltage. In some embodiments, the movable frame 1520 may be configured to interface with a plurality of fixed structures 1525 (for example, four fixed structures 1525 are illustratively depicted in FIG. 15, although greater or fewer are contemplated) to further control the desired attractive force generated by the actuator 1504 at a given applied voltage potential.

As such, an electrostatic gap-closing actuator has been provided that may provide both a larger range of motion and a larger force generated for a given voltage applied to the actuator. Such an actuator may also advantageously facilitate the generation or application of longer wipe lengths in contact elements controlled by the actuator.

As discussed above, conventional gap-closing parallel plate actuators generate large forces, but with small displacement. However, for some applications, such as for providing wipe in a switch as described herein, both large force and large displacement is desired for wiping on a contact material of the switch. To overcome this deficiency, a multi-step gap-closing actuator may be provided that steps through a total range of motion with multiple gap-closing actuators linked in series. Using such an actuator, the force-displacement curve of the actuator may be raised in the earlier portion of the gap closing distance in exchange for a smaller final resultant force at the final gap closing distance.

Figure 16:
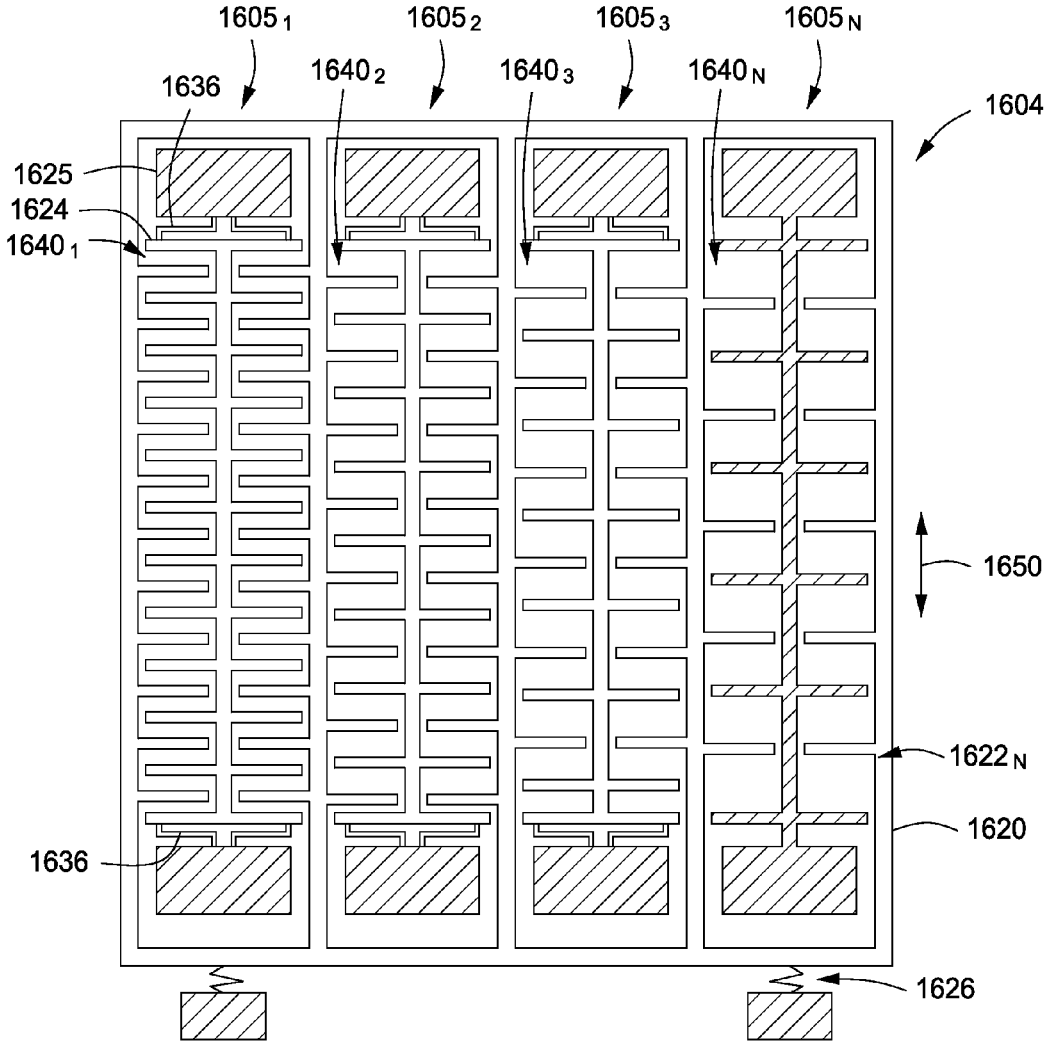
FIG. 16 depicts an actuator suitable for use in MEMS switches in accordance with some embodiments of the invention.

For example, FIG. 16 depicts a multi-stage gap closing actuator 1604 comprising a plurality of actuating stages $\mathbf{1605}_1$ to $\mathbf{1605}_n$ (illustratively movable as shown by arrows 1650). In the embodiment depicted in FIG. 16, four stages 1605 are shown, although greater or fewer stages may be utilized. The multi-stage gap closing actuator 1604 may include a movable frame 1620 having a plurality of openings corresponding to each stage 1605. The movable frame 1620 generally supports a plurality of movable electrodes 1622 in each stage $\mathbf{1605}_{1-n}$. A fixed structure 1625 may be provided within each stage $\mathbf{1605}_{1-n}$ for supporting a corresponding plurality of fixed electrodes 1624 in an opposing and interleaved configuration with the plurality of movable electrodes 1622.

The first stage $\mathbf{1605}_1$ may be provided with a first gap $\mathbf{1640}_1$ between the respective fixed and movable electrodes 1624, 1622 contained within the first stage $\mathbf{1605}_1$. The successive gaps between electrodes in each adjacent stage is increasingly larger as shown by gaps $\mathbf{1640}_2$, $\mathbf{1640}_3$, and $\mathbf{1640}_n$. As such, when the gap $\mathbf{1640}_1$ is closed in the first stage $\mathbf{1605}_1$, the gaps $\mathbf{1640}_2$, $\mathbf{1640}_3$, and $\mathbf{1640}_n$ are concomitantly reduced by the same amount, thereby bringing the electrodes in stage $\mathbf{1605}_2$ close enough to provide a sufficiently high attractive force therebetween to further continue closing the gap $\mathbf{1640}_2$, which further brings the gaps $\mathbf{1640}_3$ and $\mathbf{1640}_n$ closer together and so on until the final gap $\mathbf{1640}_n$ is closed.

The fixed structure 1625 in each of the first and in any intervening stages, for example, as shown in FIG. 16, the first stage $\mathbf{1605}_1$, the second stage $\mathbf{1605}_2$, and the third stage $\mathbf{1605}_3$, each contain one or more springs 1636 to facilitate allowing the fixed electrodes 1624 respectively coupled to the fixed structure 1625 to move as necessary to allow each subsequent stage to close.

Thus, the multi-stage gap-closing actuator 1604 advantageously may facilitate increasing the range of movement of the actuator without utilizing higher voltage or a larger die areas, thereby making such an actuator suitable for low voltage requirements (e.g., a less than 3 volt requirement, as used, for example, in cell phone applications) and thereby providing a lower cost per die for fabrication of the actuator.

Illustrative Embodiment

Figure 17:
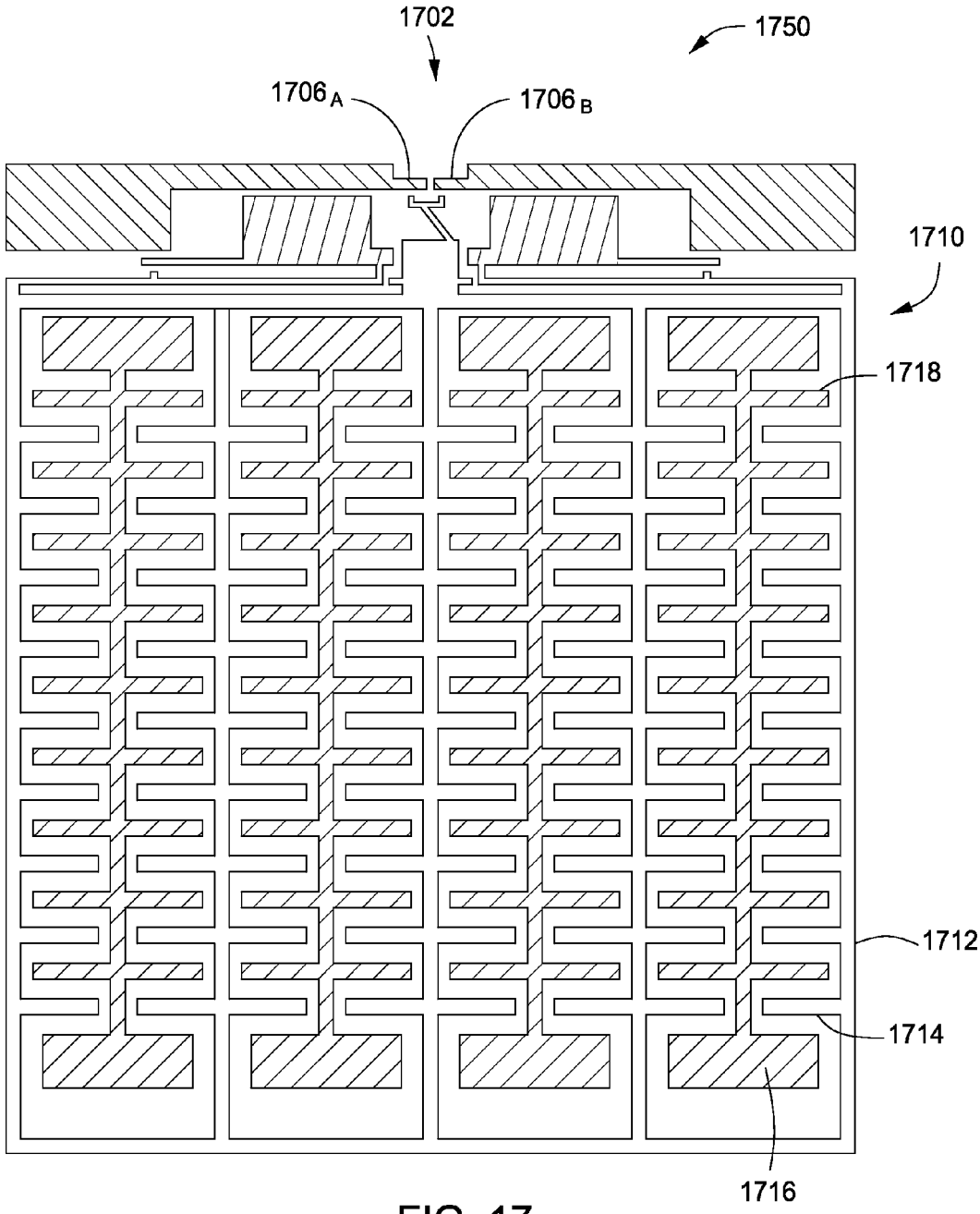
FIG. 17 depicts a schematic diagram of a MEMS switch having a multi-stage spring in accordance with some embodiments of the present invention.

As discussed above, the RF switch of the present invention may have various contact configurations and/or actuator configurations. As an illustrative example of one such configuration, FIG. 17 depicts a schematic top view of a MEMS switch 1750. The MEMS switch 1750 includes a multi-stage spring 1702 in accordance with some embodiments of the present invention coupled to an actuator 1710 for controlling the deflection of the multi-stage spring 1702 to selectively make contact with members $\mathbf{1706}_A$ and $\mathbf{1706}_B$. Control of the actuator 1710 thereby controls operation of the MEMS switch 1750 (e.g., the opening and/or closing of the MEMS switch 1750).

In the embodiment shown in FIG. 17, the actuator 1710 may illustratively be an electrostatic gap-closing actuator having a movable frame 1712 for supporting a plurality of movable electrodes 1714 coupled thereto. A fixed structure 1716 may be provided for supporting a plurality of fixed electrodes 1718 configured to interface with the movable electrodes 1714. The fixed structure 1716 may be disposed within the movable frame 1712 or otherwise configured to support the fixed electrodes 1718 in a desired position with respect to the movable electrodes 1714.

The fixed electrodes 1718 may be interleaved with and spaced apart from the movable electrodes 1714. At rest, the fixed electrodes 1718 and the movable electrodes 1714 are disposed at a first distance from each other along their respective major axes, and at least slightly off-center with respect to the gap between any two adjacent pairs of fixed electrodes 1718 or movable electrodes 1714 (i.e., the gap between the long sides of the electrodes is at least slightly greater on one side of a respective electrode than the other to facilitate consistent directional movement of the movable electrodes 1714 towards the nearer respective fixed electrode 1718, and thereby, consistent directional movement of the actuator 1710). Application of a voltage potential between the fixed electrodes 1718 and the movable electrodes 1714 causes the movable frame 1712 and the movable electrodes 1714 to move towards the fixed electrodes 1718. In the embodiment depicted in FIG. 17, such motion is in an upwards direction. As the gap between the movable electrodes 1714 and the fixed electrodes 1718 decreases, the electrostatic attraction therebetween increases, thereby applying a greater force to the multi-stage spring 1750 (as described with respect to FIG. 11, above).

A plurality of springs, for example at least partially provided by the multi-stage spring 1750, may be utilized to store a mechanical restoring force that may facilitate overcoming any contact stiction that may exist between the movable and fixed electrodes 1714, 1718, and/or between the contacts being made with the switch (e.g., between the multi-stage spring 1702 and the members $\mathbf{1706}_{A-B}$). Such restoring force facilitates returning the multi-stage spring 1702, and the actuator 1710 to a resting position (e.g., in the embodiment depicted in FIGS. 17 and 18, a position wherein the MEMS switch 1750 is open).

Figure 18:
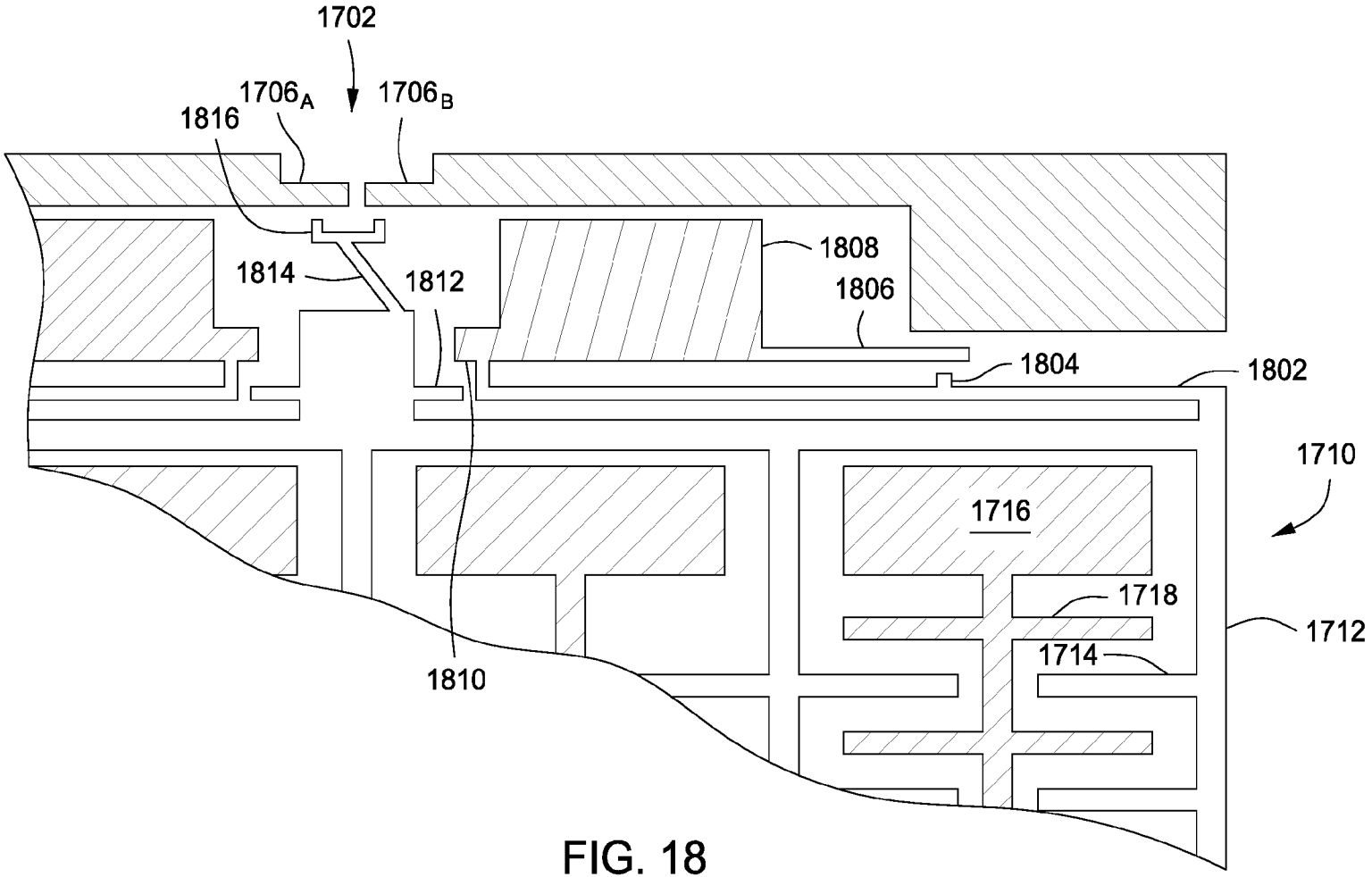
FIG. 18 depicts a close up of portions of the multi-stage spring of FIG. 18.

For example, FIG. 18 depicts a close-up view of the illustrative multi-stage spring 802 shown in FIG. 17 that details illustrative numbers and positions of springs that may be utilized to store mechanical energy during actuation of the switch, as described above. As shown in FIG. 18, a first spring 1802 may be coupled between the movable frames 1712 of the actuator 1710 and a fixed element 1808 (although FIG. 18 depicts a symmetric arrangement of springs and fixed elements, the description is limited to one side of the figure for ease of understanding).

The first spring 1802 may be configured to interface with or engage with a second spring 1806 upon a desired quantity of deflection of the first spring 1802 (e.g., upon application of an actuation voltage to the actuator 1710 to cause the actuator 1710 to begin to move, the first spring 1802 immediately begins to deflect and store mechanical energy and will engage with the second spring 1806 after continuing to move for a certain distance). In some embodiments, a protrusion 1804 may be provided to facilitate engaging the second spring 1806. The protrusion 1804 may be configured to define a desired gap between the protrusion 1804 and the second spring 1806 such that the second spring 1806 will be engaged upon a desired quantity of deflection of the first spring 1802. In the embodiment shown in FIG. 18, the second spring 1806 is shown as an extension from the fixed member 1808. However, it is contemplated that the second spring 1806 may be coupled to a different fixed member or otherwise disposed in a desired location to provide the stages of operation as described herein.

Upon continued movement of the actuator 1710, a third spring 1814 may be engaged when a contact 1816 disposed at a distal end thereof comes into contact with contacts $\mathbf{1706}_A$ and $\mathbf{1706}_B$ to close the switch. The third spring 1814 may be configured to provide a wiping action between the contact 1816 and the contacts $\mathbf{1706}_A$ and $\mathbf{1706}_B$ (e.g., a lateral movement therebetween) as the actuator 1710 continues to move towards a closed position. The wiping, and subsequent unwiping motion upon retraction of the actuator 1710 and thereby the multi-stage spring 1702, may facilitate overcoming any contact stiction between the contact 1816 and the elements $\mathbf{1706}_A$ and $\mathbf{1706}_B$. The wiping motion may further facilitate breaking through any oxide layer or particles or other contaminants that may exist between the contact 1816 and the elements $\mathbf{1706}_A$ and $\mathbf{1706}_B$, which may improve the operation of the switch (e.g., signal quality, switch lifetime, or the like).

As the actuator 1710 closes, the first spring 1802 of the multi-stage spring 1702 provides a first spring constant (k value) as the spring assembly is deflected up to a first distance (e.g., until the engagement of the second spring 1806). Once engaged, the second spring 1806 provides a greater, second spring constant (k value) when deflected beyond the first distance and up to a second distance (e.g., until the engagement of the third spring 1814). Once the third spring 1814 is engaged, a greater, third spring constant (k value) is provided as the multi-stage spring 1702 is deflected beyond the second distance and up to a third distance.

The stored mechanical energy of the actuated multi-stage spring 1702 biases the spring assembly in a direction away from the contact surface, thereby facilitating return of the multi-stage spring 1702 to its resting position and helping to overcome any contact stiction that may exist between the contacts (e.g., between contact 1816 and contacts 1806*a* and 1806*b* and/or between electrodes of the actuator 1710).

In some embodiments, the multi-stage spring assembly may be configured to have a limited range of motion (e.g., by providing a stop or other mechanism for preventing excessive travel of the multi-stage spring). In some embodiments, the limited range of motion may facilitate preventing the moving and fixed electrodes of an electrostatic, gap-closing actuator from coming into contact with each other, thereby preventing any contact stiction from developing between the electrodes and facilitating extending the lifetime of the actuator. For example, in the embodiment depicted in FIGS. 17-18 a protrusion 1812 may be provided to interface with a corresponding protrusion 1810 that limits the travel of the multi-stage spring 1702 towards the closed position. The location and geometry of the protrusions 1810, 1812 are illustrative only and many other geometries and configurations may be utilized to limit the travel of the multi-stage spring 1702.

Thus, embodiments of multi-stage spring assemblies that provide variable spring compliance that shapes the mechanical characteristics of the spring system have been described herein. In some embodiments, the mechanical characteristics of the spring system may be shaped to conform to forces applied by an actuating means coupled to the multi-stage spring system. The multi-stage spring system may offer different compliant levels at different deflection locations. In a non-limiting example, the multi-stage spring system may be utilized to provide a compact, high-density, low-voltage MEMS switch. For example, the multi-stage spring system can be used as part of, or in conjunction with, a MEMS parallel-plate actuator (e.g., an electrostatic gap-closing actuator) for various applications, including RF switches. The multi-stage spring system may advantageously provide higher contact-breaking forces in such a MEMS switching device.

Figure 19:
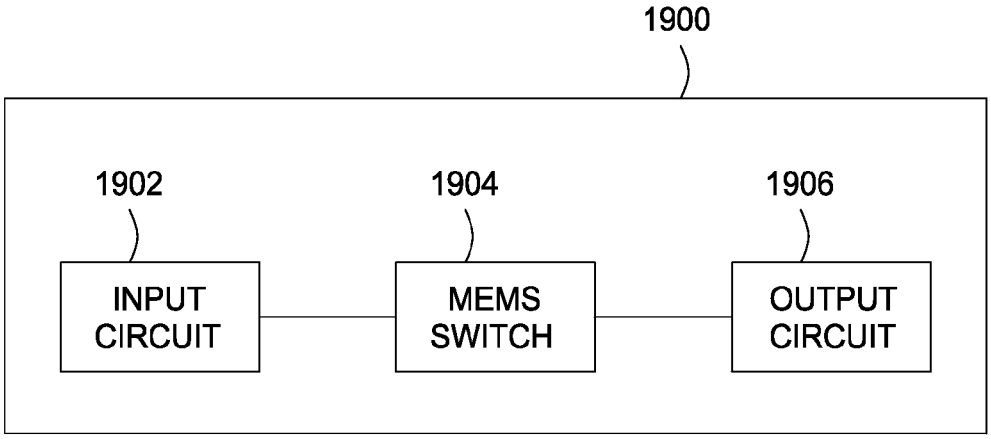
FIG. 19 depicts an electronic device having a MEMS switch in accordance with some embodiments of the present invention.

In some embodiments, a MEMS switch in accordance with the teachings provided herein may be provided in an electronic device. For example, FIG. 19 depicts an electronic device 1900 having an input circuit 1902 for providing a signal and an output circuit 1906 for receiving the signal from the input circuit 1902. A MEMS switch 1904 may be provided to selectively couple the input circuit 1902 to the output circuit 1906 as described in more detail above.

The electronic device may be any electronic device having an internal electronic switch that controls aspects of the operation thereof. Non-limiting examples of suitable electronic devices include portable and non-portable electronic devices (for example, portable phones (e.g., cell phones, smart phones, or the like), personal digital assistants, music players (e.g., radios, digital music players, or the like), digital cameras and/or video cameras, electronic games, navigational devices, computers and/or computing devices, televisions and/or video players, multimedia players, or the like), or the like. Such electronic devices may portable, non-portable, installed electronic devices (such as any of the preceding installed in a home, vehicle, or other location), or the like.

Thus, a MEMS switch and apparatus or devices incorporating the same have been provided herein. In some embodiments, the MEMS switch may advantageously wipe a contact surface of the switch, which may enhance switch performance and extend switch lifetime. In some embodiments, the switch may include a multi-stage spring system that advantageously stores a greater restoring force (as compared to conventional switches) that may facilitate returning the switch to an open position when the switch is turned off. In some embodiments, the switch may include one or more of various contact elements that may advantageously provide one or more of a wipe motion against a contact pad, an increased wipe for a given actuation distance, or the like. In some embodiments, the switch may include one or more of various electrostatic actuators that may advantageously provide one or more of a higher force generated for a given voltage potential, a greater range of motion of the actuator, or the like.

While the foregoing is directed to embodiments of the present invention, other and further embodiments of the invention may be devised without departing from the basic scope thereof, and the scope thereof is determined by the claims that follow.

The invention claimed is:

1. A MEMS switch, comprising:

a resilient contact element comprising a resilient beam and a tip configured to wipe a contact surface; and a MEMS actuator comprising the contact surface and having an open position that maintains the tip and the contact surface in a spaced apart relation and a closed position that brings the tip into contact with the contact surface, wherein the resilient contact element and the MEMS actuator are disposed on a substrate and are movable in a plane substantially parallel to the substrate.

2. The switch of claim 1, wherein the resilient contact element is coupled to the actuator.

3. The switch of claim 1, wherein the MEMS actuator is at least one of a comb actuator, a gap closing actuator, an angled gap closing actuator, a partitioned MEMS actuator, or a multi-stage actuator.

4. The switch of claim 1, wherein the actuator provides a contact force greater than or on the order of mN at an actuation voltage of less than or equal to about 3 Volts.

5. The switch of claim 1, wherein at least one of the contact surface or the tip comprises rhodium.

6. The switch of claim 1, wherein the actuator and the resilient contact element are lithographically formed on a common substrate.

7. The switch of claim 1, wherein the resilient contact element is part of a spring assembly having a first spring constant when deflected up to a first distance, a greater, second spring constant when deflected beyond the first distance and up to a second distance, and a greater, third spring constant when deflected beyond the second distance and up to a third distance, and wherein the spring assembly stores mechanical energy when deflected towards a contact surface that biases the spring assembly away from the contact surface.

8. A MEMS switch, comprising:

a resilient contact element comprising a beam flexible about a pivot point and a having a tip disposed proximate an end of the beam and configured to engage a contact surface; and a MEMS actuator coupled to the resilient contact element and having an open position that maintains the tip and the contact surface in a spaced apart relation and a closed position that brings the tip into contact with the contact surface, wherein the actuator is directly engaged with the beam at a point remote from the pivot point, and wherein the resilient contact element and the MEMS actuator are disposed on a substrate and movable in a plane substantially parallel to the substrate.

9. The switch of claim 8, wherein operation of the actuator pulls the beam towards the actuator.

10. The switch of claim 8, wherein the actuator is coupled to the beam on the same side of the pivot point as the tip.

11. The switch of claim 8, wherein the actuator is coupled to the beam on a side of the pivot point opposite the tip.

12. The switch of claim 8, further comprising:

a selectively engageable locking mechanism configured to bias the tip into contact with the contact surface and wherein operation of the actuator selectively opens the switch.

13. The switch of claim 8, further comprising:

a second resilient contact element comprising a beam and a tip configured to wipe a contact surface, the resilient element and the second resilient element both coupled to the actuator.

14. The switch of claim 13, wherein actuation causes the resilient element and the second resilient element to move in the same direction.

15. The switch of claim 13, wherein actuation causes the resilient element and the second resilient element to move in opposite directions.

16. The switch of claim 8, wherein the pivot point of the beam is closer to the actuator than to the tip.

17. The switch of claim 8, wherein the pivot point of the beam is closer to the tip than to the actuator.

18. The switch of claim 1, wherein:

the MEMS actuator comprises a movable portion that is movable between the open position and the closed position, and the movable portion comprises the contact surface.

19. The switch of claim 18 further comprising mechanical energy storing means for storing mechanical energy as the movable portion moves from the open position to the closed position sufficient to move the movable portion from the closed position back to the open position.

20. The switch of claim 19, wherein the mechanical energy storing means comprises mechanical springs coupled to the movable portion of the MEMS actuator.

21. The switch of claim 20 further comprising a fixed structure, wherein the mechanical springs are also coupled to fixed structure.

22. The switch of claim 1, wherein the resilient beam is linear.

23. The switch of claim 1, wherein the resilient beam is non-linear.

24. The switch of claim 1, wherein the resilient beam comprises a reinforcement member.

* * * * *